US009828814B1

(12) United States Patent
Tran et al.

(10) Patent No.: US 9,828,814 B1
(45) Date of Patent: Nov. 28, 2017

(54) POWER TONGS WITH SHAFT RETAINERS

(71) Applicant: U.S. POWER TONG, L.L.C., Odessa, TX (US)

(72) Inventors: Gerry Chau Tran, Fort Worth, TX (US); Billy Shawn Boyd, Midland, TX (US)

(73) Assignee: U.S. Power Tong, L.L.C., Odessa, TX (US)

( * ) Notice: Subject to any disclaimer, the term of this patent is extended or adjusted under 35 U.S.C. 154(b) by 0 days.

(21) Appl. No.: 15/647,534

(22) Filed: Jul. 12, 2017

(51) Int. Cl.
*E21B 19/16* (2006.01)

(52) U.S. Cl.
CPC ..... *E21B 19/164* (2013.01)

(58) Field of Classification Search
CPC .... E21B 19/164; E21B 19/162; E21B 19/163; E21B 19/168; B23P 19/061; B25B 13/50
See application file for complete search history.

(56) References Cited

U.S. PATENT DOCUMENTS 4,084,453 A * 4/1978 Eckel ..... E21B 19/164 81/57.18
4,089,240 A * 5/1978 Eckel ..... E21B 19/164 81/57.18
4,192,206 A 3/1980 Schulze-Beckinghausen
4,290,304 A 9/1981 Eckel
4,346,629 A * 8/1982 Kinzbach ..... E21B 19/164 81/57.15
4,401,000 A * 8/1983 Kinzbach ..... E21B 19/164 81/57.15
4,402,239 A 9/1983 Mooney
4,404,876 A * 9/1983 Eckel ..... E21B 19/164 81/57.18
RE31,699 E 10/1984 Eckel
4,487,092 A 12/1984 Neves
4,574,664 A 3/1986 Curry
4,590,823 A 5/1986 Neves
5,207,128 A 5/1993 Albright
6,082,224 A * 7/2000 McDaniels ..... B25B 1/241 81/57.15
6,318,199 B1 11/2001 Buck
6,330,911 B1 12/2001 Allen
6,443,241 B1 9/2002 Juhasz et al.
6,446,524 B1 * 9/2002 Gravouia ..... E21B 19/164 74/459.5
6,619,160 B1 9/2003 Buck
7,000,503 B2 * 2/2006 Dagenais ..... E21B 19/164 81/432
7,762,160 B2 7/2010 Basler
(Continued)

OTHER PUBLICATIONS http://www.oilfieldsupply.com/images/library/1500.1500/product-1790496944.jpg.

*Primary Examiner* — David B Thomas
(74) *Attorney, Agent, or Firm* — The Elliott Law Firm, PLLC; Douglas H. Elliott; Nathan Q. Huynh

(57) ABSTRACT

One or more specific versions disclosed herein includes a power tong for rotating tubulars in wellbore operations comprising: a gear shaft having a non-threaded portion; a gear rotatably connected to the non-threaded portion of the gear shaft; a tong plate having an inner surface, an outer surface, and a gear shaft aperture, wherein an end of the non-threaded portion is disposed in the gear shaft aperture; and a shaft retainer that is removably coupled to the tong plate and abutted against the end of the non-threaded portion.

20 Claims, 24 Drawing Sheets

(56) References Cited

U.S. PATENT DOCUMENTS

| | | | | |
|---|---|---|---|---|
| 7,882,767 | B2 * | 2/2011 | Musemeche | E21B 19/164 81/57.15 |
| 7,963,196 | B2 | 6/2011 | Musemeche et al. | |
| 7,992,274 | B2 | 8/2011 | Hickman | |
| 8,453,541 | B2 | 6/2013 | Dagenais et al. | |
| 9,010,219 | B2 | 4/2015 | Feigel et al. | |
| 2009/0272235 | A1 | 11/2009 | Berry | |
| 2009/0277308 | A1 | 11/2009 | Light et al. | |
| 2011/0030512 | A1 | 2/2011 | Begnaud, Jr. | |

* cited by examiner

POWER TONGS WITH SHAFT RETAINERS

BACKGROUND

1. Field of Inventions

The field of this application and any resulting patent relates to power tongs.

2. Description of Related Art

During drilling of oil and gas wells and production of materials therefrom, various operations require the connection and disconnection of successive sections of threaded tubulars such as pipe, casing, or tubing. Tools known as power tongs are used to "make" and "break" such connections. Workers on the rig use these power tongs to provide low-torque, high-speed rotation of the pipe up until full connection with the next pipe. Then, the power tong may be shifted into a low-speed, high-torque setting to complete the mating of the connection. By the same vein, when removing pipe from the wellbore, workers often use the same power tongs at high-torque settings to break the connection, then they may shift the tong into a high-speed, low-torque rotation mode to unthread the connection, after which the two tubular sections are separated. Hydraulic motors and gear trains, normally part of the power tong are used to deliver the necessary torque both during the making up and breaking of the connection.

In the past, various power tongs may have been capable of delivering high torque. However, the bodies of those power tongs have sometimes failed to withstand the tension exerted by the gear train during high torque applications. Indicative of such failure was any buckling or wrenching of the power tong body (e.g., tong plates and frame). The gear assemblies in those power tongs were coupled to the tong plates to form a single, interconnected unit, i.e., the power tong itself. As high torque is delivered to the gear train, each gear assembly that transfers torque to a subsequent gear assembly also receives resistance (opposing force) from the subsequent gear assembly. Tension from the opposing gear assemblies is distributed to any interconnected medium, such as the tong plates, which may buckle and deform under tension beyond what the tong plates may receive.

Continued deformation of those power tong bodies tend to eventually loosen couplings within and between internal components, which accelerates damage and failure to those power tongs. Therefore, a need exists for a power tong to be reinforced internally for high-torque usage and to minimize deformation of the power tong body.

Setting aside potential failures due to use under high torque, prior power tongs have still tended to break down under normal usage. When those power tongs break down, drilling necessarily must stop for workers to repair or replace worn components within those power tongs. Worse, many repair or replacement operations have necessarily been performed with the upper tong plate removed, requiring additional time to dismantle additional components. Such operations are time consuming and lead to cost overruns and lost revenue. Furthermore, any dismantling and re-installing of the tong components as part of a repair or replacement procedure creates additional risk that the re-installation is done improperly, and that the power tong is thus vulnerable to future problems. Accordingly, another need exists for a power tong that may be quickly serviced and where certain components within the power tong body may be replaced without removing the upper tong plate.

Various power tong structures and methods for assembling power tongs have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve, as discussed above. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes a power tong for rotating tubulars in wellbore operations comprising: a gear shaft having a non-threaded portion; a gear rotatably connected to the non-threaded portion of the gear shaft; a tong plate having an inner surface, an outer surface, and a gear shaft aperture, wherein an end of the non-threaded portion is disposed in the gear shaft aperture; and a shaft retainer that is removably coupled to the tong plate and abutted against the end of the non-threaded portion.

The disclosure herein includes a power tong for rotating tubulars in wellbore operations comprising: a gear shaft having a threaded portion and a non-threaded portion; a gear rotatably connected to the non-threaded portion of the gear shaft; a tong plate having an inner surface, an outer surface, and a gear shaft aperture, wherein an end of the non-threaded portion is disposed in the gear shaft aperture; a shaft retainer having an aperture, wherein the shaft retainer is coupled to the outer surface of the tong plate and abutted against the end of the non-threaded portion; and a threaded assembly coupled to the threaded portion of the gear shaft and disposed against the outer surface of the shaft retainer.

DETAILED DESCRIPTION

1. Introduction

Figure 1A:
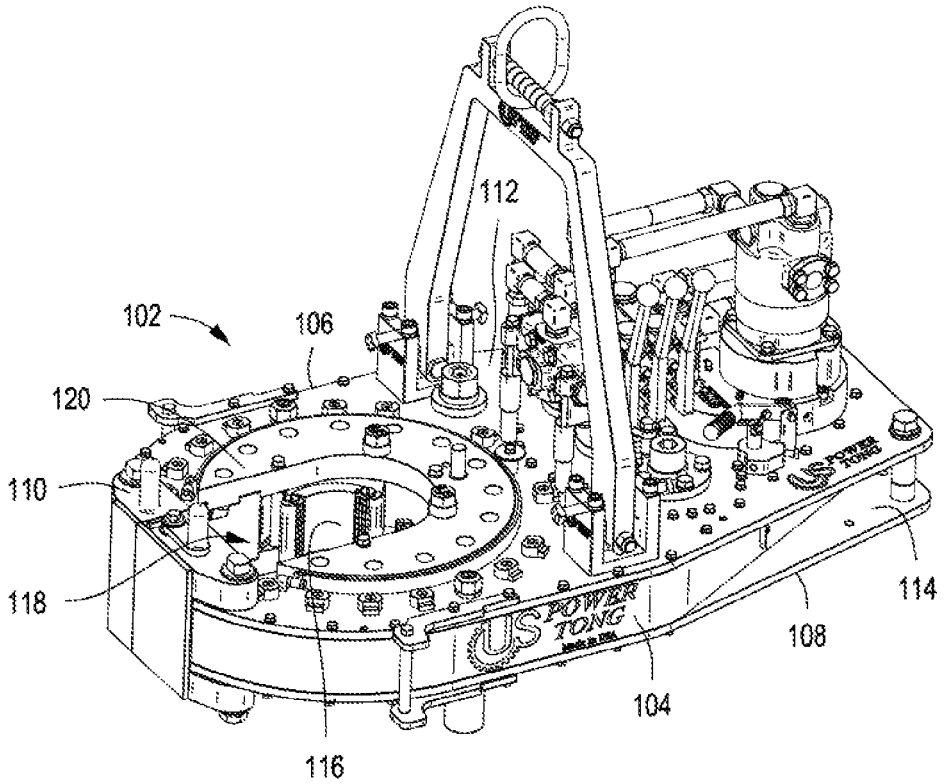
FIG. 1A shows a perspective top view of an example of a power tong of the disclosure.
Figure 1B:
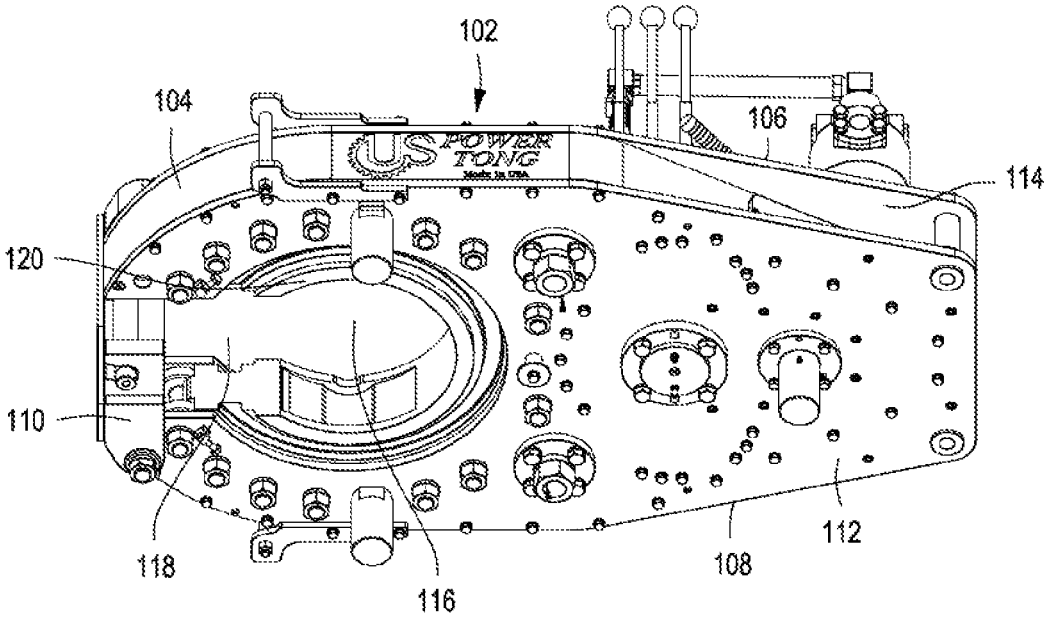
FIG. 1B shows a perspective bottom view of FIG. 1A.

A detailed description will now be provided. The purpose of this detailed description, which includes the drawings, is to satisfy the statutory requirements of 35 U.S.C. §112. For example, the detailed description includes a description of the inventions and sufficient information that would enable a person having ordinary skill in the art to make and use the inventions defined by the claims. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "coupled" as used herein is defined as directly or indirectly connected, attached, or integral with, e.g., part of. A first object may be coupled to a second object such that the first object is positioned at a specific location and orientation with respect to the second object. A first object may be either permanently or removably coupled to a second object. Two objects may be permanently coupled to each other via adhesive, welding, or mechanically pressed together; or they may be removably coupled via nails, screws, or nuts and bolts. Thus, a flange of a shaft may be removably coupled to an inner surface of a tong plate such that the flange may then be uncoupled and removed from the tong plate. A shaft retainer may be removably coupled to an outer surface of a tong plate such that the shaft retainer may then be uncoupled and removed from the tong plate. Also, two objects may be capable of being threadably coupled together. e.g., where a threaded outer surface of one object is capable of engaging with or to a threaded inner surface of another object. Thus, a threaded assembly may be threadably coupled to a threaded portion of a gear shaft where a threaded inner surface of the threaded assembly engages with or to a threaded outer surface of the threaded portion of the gear shaft.

The term "ingress" as used herein is defined as going in or passing through from outside to inside or entering. For example, ingress of a gear shaft into a power tong may be achieved when the gear shaft is inserted through a gear shaft aperture disposed in the tong plate from an outer surface of the tong plate towards an inner surface of the tong plate. Likewise, ingress of a gear shaft into a gear may be achieved when the gear shaft is inserted through a central aperture disposed in the gear, e.g., such that the gear becomes rotatably connected to the gear shaft.

The term "egress" as used herein is defined as going out or passing through from inside to outside or exiting. For example, egress of a gear shaft out of a power tong may be achieved when the gear shaft is extracted through a gear shaft aperture disposed in the tong plate from an inner surface of the tong plate towards an outer surface of the tong plate. Likewise, egress of a gear shaft out a gear may be achieved when the gear shaft is extracted through a central aperture disposed in the gear, e.g., such that the gear is no longer rotatably connected to the gear shaft.

The term "rotatably connected" as used herein is defined as directly or indirectly coupled, yet still free to rotate about an axis. Two objects may be rotatably connected when one object connects with the other and one object remains free to rotate about the other. Thus, a gear, having a central aperture, may be rotatably connected to a gear shaft, e.g., where a non-threaded portion of the gear shaft is positioned and retained in the central aperture and the gear may remain free to rotate about the gear shaft. A gear and gear shaft may be held rotatably connected by snap rings disposed on the central aperture of the gear.

The term "abutted against" as used herein is defined as being positioned adjacent to and either physically touching or pressing against, directly or indirectly. For example, a first object may be abutted against a second object such that the second object is limited from moving in a direction of the first object. Thus, a shaft retainer may be abutted against an end of a non-threaded portion of a gear shaft such that the shaft retainer prevents the gear shaft from moving in a direction of the shaft retainer. A shaft retainer may be abutted against a tong plate, e.g., where an inner surface of the shaft retainer is abutted against an outer surface of the tong plate and the shaft retainer may cover a gear shaft aperture disposed in the tong plate. A gear shaft retainer may be abutted against a tong plate and held pressed to the tong plate by bolts, e.g., where the bolts pass through the shaft retainer and are threadably coupled to the tong plate. A gear shaft retainer may be abutted against a tong plate and held pressed to the tong plate by bolts and a threaded assembly, e.g., where the threaded assembly includes a washer that is disposed against and in physical contact with the outer surface of the shaft retainer and a nut having a threaded inner surface that is disposed against and in physical contact with the washer.

The term "moved laterally" as used herein is defined as moved or displaced in a direction parallel to the nearest planar surface, e.g., the inside surface of a power tong plate For example, an object is moved laterally when the object has been displaced from one point to another on a geometric plane. Thus, a gear is capable of being moved laterally in a power tong if the gear may be displaced from one side within the power tong towards another side, preferably in a direction parallel to one of the power tong plates. A strut is capable of being moved laterally in a power tong if the strut may be displaced from one side within the power tong towards another side, preferably in a direction parallel to one of the power tong plates.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., as a groove. An aperture can be an opening in an object that is completely circumscribed, defined, or delimited by the object itself. Alternatively, an aperture can be an opening in the object when the object is combined with one or more other objects or structures. One or more apertures may be disposed and pass entirely through a tong plate, gear shaft retainer, gear, bearing, washer, and spacer. An aperture may receive another object and permit ingress and/or egress of the object through the aperture. Thus, a non-threaded portion of gear shaft may be received in an aperture of a tong plate. A gear shaft may be capable of ingress and/or egress through an aperture of a tong plate. A threaded portion of a gear shaft may extend through an aperture of a gear retainer, washer, or spacer.

The term "arcuate wall" as used herein is defined as any curved wall or structure having a curved planar surface. An arcuate wall may be a wall having curved sides that may or may not be parallel to one another. For example, an arcuate wall may be a curved wall whose cross section resembles a letter "C," as exemplified by some of the struts disclosed herein. Thus, for example, a stint may be an arcuate wall with parallel curved sides.

The term "cylindrical" as used herein is defined as shaped like a cylinder, e.g., having straight parallel sides and a circular or oval or elliptical cross-section. A cylindrical body or structure, e.g., gear shaft or gear, may be completely or partially shaped like a cylinder. A cylindrical body, e.g., gear shaft, that has an outer diameter that changes abruptly may have a radial face or "lip" (see, e.g., 214, FIGS. 3-12) extending toward the center axis. A cylindrical body may have an aperture that extends through the entire length of the body to form a hollow cylinder that is capable of permitting objects to pass through, e.g., gear shaft, bolts, or screws. A gear shaft retainer, gear, bearing, washer, or spacer may be a cylindrical body that has an aperture permitting all or portions of a gear shaft to pass through. On the other hand, a cylindrical structure may be solid, e.g., rod or peg. A gear shaft is an example of a solid cylindrical body.

The term "surface" as used herein means any outer or inner face of a body or thing, such as a plate or a cylinder. A "surface" may be, for example, any flat or substantially flat portion of a plate, including, for example, any part or the entire flat portion of a tong plate. A surface may also refer to that flat or substantially flat area that extend radially around a cylinder which may, for example, be part of a gear shaft or a gear. One example of the term "surface" is a tong plate may have an inner surface and an outer surface, which may be flat, and the inner surface faces the internal components of a power tong and the outer surface faces the opposite direction. Another example may relate to a cylindrical structure, e.g., a washer, a gear wheel, a bearing, or a nut, having an inner surface defined by a central aperture and circumscribed by an outer surface.

The term "tong plate" as used herein refers to a flat structure formed from a flat piece of metal, e.g., any plate that is capable of coupling to a frame from above or below. An upper tong plate may cover internal components of a power tong from above, e.g., gear train, struts, or cage plate assembly. A lower tong plate may cover internal components of a power tong from below. A tong plate may have an inner surface, an outer surface, and a gear shaft aperture, wherein an end of a non-threaded portion of gear shaft may be disposed in the gear shaft aperture. A tong plate may have an inner surface and an outer surface, wherein the flange of a gear shaft may be removably coupled to the inner surface of the tong plate. A tong plate may have an inner surface and an outer surface, wherein the flange of a gear shaft may be removably coupled to the inner surface of the tong plate. A tong plate may have an inner surface and an outer surface, wherein a flange of a gear shaft is in physical contact with the inner surface of the tong plate and a threaded assembly is in physical contact with outer surface of the tong plate.

The term "assembly" as used herein means any set of components that have been fully or partially assembled together.

The term "cage plate assembly" as used herein refers to an assembly that is capable of gripping and rotating a tubuldar about a center of rotation. A cage plate assembly can be part of a power tong e.g., mounted on one or more of the power tong plates. A cage plate assembly preferably is capable of receiving a tubular through an opening ("throat") that can be aligned with the throat in upper and lower tong plates of a power tong. Rotational movement of a cage plate assembly can in certain cases be driven by a gear train engaged with a rotary gear of the cage plate assembly, which can be capable of cooperating with jaws mounted on the cage plate assembly for gripping tubulars.

The term "gear assembly" as used herein refers to an assembly that is capable of transferring torque and includes at least one gear. A gear assembly can be, for example, a set of components assembled to form a torque-transferring unit of a gear train as part of a power tong. As illustrated in FIGS. 3-12, a gear assembly may include a gear, a gear shaft, one or more gear retainers, one or more threaded assemblies, one or more spacers, and one or more snap rings. A gear assembly may be removably coupled to an upper tong plate, a lower tong plate, or both.

The term "gear" as used herein refers to a cylindrical assembly that includes a gear wheel and one or more bearings. An example of a gear is shown in FIGS. 3-12. A gear wheel and a bearing of a gear may, for example, each have a central aperture defining a continuous inner wall, and may all share a central axis line. Additionally, a bearing may be radially sized to be disposed concentrically in the aperture of the gear wheel and retained therein by one or more snap rings coupled to the inner wall of the gear wheel. Thus, when assembled with one or more bearings, a gear has a central aperture that may inherit the central aperture of its one or more bearings. Additionally, the gear may share an axial center line with tong plate apertures in tong plates of the power tong, as shown in FIGS. 3-12. A gear may be rotatably connected to a non-threaded portion of a gear shaft, around which the gear may rotate. A gear is capable of being moved laterally within a power tong after egress of a gear shaft through a gear shaft aperture of a tong plate of the power tong.

The term "gear shaft" as used herein refers to a cylindrical structure about which a gear may be capable of rotating. In certain cases, a gear shaft may have opposing ends and a non-threaded portion. A gear shaft may in some cases have a threaded portion, e.g., on one end or on both ends. A gear shaft may have a non-threaded portion and flange on one end of the non-threaded portion. The flange may in some cases be removably coupled to an inner surface of a tong plate. A gear shaft may in some cases act as an axle where its non-threaded portion is extended through a central aperture of a gear, around which the rotatably connected gear may rotate. Additionally, in certain cases, an end of the non-threaded portion of a gear shaft may be received in an aperture in a tong plate such that the end may be abutted against a gear shaft retainer that is removably coupled to an outer surface of the tong plate. Moreover, a threaded portion adjacent to an end of a non-threaded portion of a gear shaft may extend through an aperture in a shaft retainer, tong plate, washer, and/or spacer. A gear shaft may in some cases be capable of ingress or egress through an aperture in a tong plate, e.g., after the gear shaft has been uncoupled from the tong plate.

The term "non-threaded" as used herein is defined as having no threads. A non-threaded portion may be any portion of a structure or surface that has no threads. A non-threaded portion may, for example, refer to a cylindrical substructure of a gear shaft with two opposing circular ends and a smooth or substantially smooth outer surface with no threads on any part of the outer surface. A gear shaft may include a "threaded portion" wherein a section of the gear shaft includes a section of the gear shaft without threads, e.g., a smooth portion of a gear shaft surface. As shown in FIGS. 3-12, a non-threaded portion of a gear shaft may, for example, have a diameter sized so that the gear shaft can be slidably received in an aperture of a gear or tong plate. Specifically, an aperture of a gear may in some cases receive a non-threaded portion of a gear shaft so that the gear may be rotatably connected and retained (by one or more snap rings) on the gear shaft, which may freely rotate about an axis of the gear shaft, as shown in FIGS. 3-12.

The term "threaded" as used herein is defined having threads. Threads may include one or more helical protrusions or grooves on a surface of a cylindrical object. Each full rotation of a protrusions or groove around a threaded surface of the object is referred to herein as a single "thread." A gear shaft may include a "threaded portion" wherein a section of the gear shaft includes threads. A threaded portion of the gear shaft may extend from an end of a non-threaded portion of the gear shaft. A gear shaft may include more than one threaded portion. For example, a gear shaft may include two end portions having threads with a non-threaded portion positioned between them. A threaded portion may, for example, refer to a portion of a cylindrical substructure of a gear shaft having a threaded outer surface for mating with threads on a nut. As shown in FIGS. 3-12, a threaded portion may have a diameter sized to extend through an aperture of a gear retainer, washer, or spacer. In certain cases, a threaded portion of a structure may be removably coupled to a threaded assembly.

The term "shaft retainer" as used herein refers to a structure having an inner surface and an outer surface that are preferably parallel to one another, which structure is capable of directly or indirectly retaining a shaft. Preferably, a shaft retainer can be mounted over an aperture of a tong plate and removably coupled to an outer surface of the tong plate, as shown in FIGS. 3-12. A shaft retainer preferably includes a flat plate with an inner surface and an outer surface, wherein the inner surface of the shaft retainer can be disposed against the outer surface of a tong plate. A shaft retainer can, in certain cases, be coupled to an outer surface of a tong plate via a structure selected from the group of bolts, screws, clamps, welding, and adhesive. Additionally, an inner surface of a shaft retainer may in certain cases be abutted against an end of a non-threaded portion of a gear shaft so as to prevent egress of a gear shaft from a power tong, as exemplified in FIGS. 3-12. Conversely, uncoupling of a gear shaft retainer from a tong plate may in some cases remove obstruction against egress of the gear shaft from the power tong.

The term "strut" as used herein refers to any solid or semi-solid structure. Preferably a strut is a structure capable of being removably coupled to an inner surface of a tong plate and more preferably coupled to two tong plates with opposing surfaces that face one another. In some cases, removable coupling of a strut to a tong plate may prevent the tong plate from shifting or separating relative to the struts, or at least substantially inhibit such movement. The coupling of struts to two tong plates may provide for a reinforcing barrier around a gear train thus resisting any deforming effects that might otherwise be caused when high torque is imparted to the gear train. As shown in FIG. 1 and FIG. 2, each strut may be an arcuate wall. In certain versions, multiple arcuate walls (struts) may be located in certain spaces between different assemblies that are part of the power tong, e.g., space between a gear train and a frame of a power tong. Any or all of the struts may be a wall or may alternatively be a cylindrical, polygonal, and/or irregular structure, or a tubular structure, rod, polygonal cube, or walls having irregular contours. Referring to FIG. 1 and FIG. 2, the struts are each solid members. However, a strut may alternatively be formed from multiple smaller, interconnected subunits, and preferably remains rigid to withstand forces exerted between opposing gear assemblies of the gear train under high torque operations.

The term "threaded assembly" as used herein refers to an assembly that includes threads, and preferably also includes one or more nuts, one or more bolts, one or more washers, and/or one or more spacers used for coupling two objects together. A nut, a washer, and a spacer may, for example, share a common central axis line. A nut may have a threaded inner surface that may mesh with outer threads on an object, e.g., threaded portion of a gear shaft. A bolt may have a threaded outer surface that may mesh with inner threads on an object, e.g., threads in a gear shaft retainer, a tong plate, or a flange of a gear shaft. A threaded assembly may comprise a washer that is disposed against and in physical contact with the outer surface of the shaft retainer and a bolt having a threaded outer surface that is disposed against and in physical contact with the washer. When coupled to the threaded portion, the threaded assembly may be abutted against an outer surface of a shaft retainer or a tong plate. A threaded assembly may further include one or more washers and/or one or more spacers disposed against a shaft retainer or a tong plate. A threaded assembly may be coupled to a threaded portion of a gear shaft and disposed against an outer surface of a shaft retainer. A threaded assembly may be coupled to a threaded portion of a gear shaft and disposed against an outer surface of a tong plate.

3. Certain Specific Embodiments

Certain specific versions of methods, structures, elements, and parts are described below, which are by no means an exclusive description of the inventions. Other specific embodiments, including those referenced in the drawings, are encompassed by this application and any patent that issues therefrom.

The disclosure herein includes a power tong for rotating tubulars in wellbore operations comprising: a gear shaft having a non-threaded portion; a gear rotatably connected to the non-threaded portion of the gear shaft; a tong plate having an inner surface, an outer surface, and a gear shaft aperture, wherein an end of the non-threaded portion is disposed in the gear shaft aperture; and a shaft retainer that is removably coupled to the tong plate and abutted against the end of the non-threaded portion.

The disclosure herein includes a power tong for rotating tubulars in wellbore operations comprising: a gear shaft having a threaded portion and a non-threaded portion; a gear rotatably connected to the non-threaded portion of the gear shaft; a tong plate having an inner surface, an outer surface, and a gear shaft aperture, wherein an end of the non-threaded portion is disposed in the gear shaft aperture; a shaft retainer having an aperture, wherein the shaft retainer is coupled to the outer surface of the tong plate and abutted against the end of the non-threaded portion; and a threaded assembly coupled to the threaded portion of the gear shaft and disposed against the outer surface of the shaft retainer.

The disclosure herein includes a method for uninstalling a gear assembly in a power tong for rotating tubulars in wellbore operations, comprising rotating a cage plate assembly having a throat so that the throat faces the gear assembly; uncoupling a respective shaft retainer from a first tong plate and a second tong plate to uncover an aperture in each tong plate; extracting a gear shaft from the gear assembly through either aperture of the tong plates; laterally moving a gear of the gear assembly within the power tong towards the throat of the cage plate assembly; and extracting the gear through the throat.

The disclosure herein includes a method for uninstalling a gear assembly in a power tong for rotating tubulars in wellbore operations, comprising: rotating a cage plate assembly having a throat so that the throat faces the gear assembly; uncoupling a threaded assembly from each threaded portion of a gear shaft of the gear assembly; uncoupling a shaft retainer from a tong plate to uncover an aperture in the tong plate; extracting the gear shaft from the gear assembly through the aperture of the tong plates; laterally moving a gear of the gear assembly within the power tong towards the throat of the cage plate assembly; and extracting the gear through the throat.

In any one of the methods, structures, elements or parts disclosed herein, the threaded portion of the gear shaft extends through the aperture of the shaft retainer.

In any one of the methods, structures, elements or parts disclosed herein, the shaft retainer is abutted against a circular face of the end of the non-threaded portion.

In any one of the methods, structures, elements or parts disclosed herein, the gear shaft aperture is sized to receive the non-threaded portion of the gear shaft.

In any one of the methods, structures, elements or parts disclosed herein, the gear shaft is capable of ingress into or egress from the power tong through the gear shaft aperture.

In any one of the methods, structures, elements or parts disclosed herein, the gear is capable of being moved laterally within the power tong after egress of the gear shaft through the gear shaft aperture.

In any one of the methods, structures, elements or parts disclosed herein, the shaft retainer is removably coupled to the outer surface of the tong plate.

In any one of the methods, structures, elements or parts disclosed herein, the shaft retainer is coupled to the outer surface of the tong plate via a structure selected from the group of bolts, screws, clamps, welding, and adhesive.

In any one of the methods, structures, elements or parts disclosed herein, the shaft retainer comprises a flat plate with an inner surface and an outer surface, and the inner surface of the shaft retainer is disposed against the outer surface of the tong plate.

In any one of the methods, structures, elements or parts disclosed herein, the threaded assembly comprises a nut having a threaded inner surface.

In any one of the methods, structures, elements or parts disclosed herein, the threaded assembly comprises a washer that is disposed against and in physical contact with the outer surface of the shaft retainer and a nut having a threaded inner surface that is disposed against and in physical contact with the washer.

In any one of the methods, structures, elements or parts disclosed herein, the gear comprises a gear wheel having an aperture; a bearing disposed concentrically in the aperture of the gear wheel; and one or more snap rings disposed concentrically in the aperture of the gear wheel.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of power tongs shown in the drawings, which relate to power tongs, elements and parts that can be part of a power tong, and methods for removing or replacing elements and parts of such power tongs. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The views A-D of FIG. 1 illustrate an example of a power tong 102. The power tong 102 includes a frame 104, an upper tong plate 106, a lower tong plate 108, and a door assembly 110. The upper tong plate 106 may be securely mounted above the frame 104 and the lower tong plate 108 may be mounted below the frame 104. Each tong plate 106, 108 has an outer surface 112, an inner surface 114, and a central opening 116, preferably a circular "C"-shaped opening with a throat 118. The door assembly 110 may be pivotally mounted to the tong plates 106, 108 adjacent to the throat 118 so that a tubular section may be placed in the throat 118 of the power tong 102. A door latch mechanism (not shown) may also be provided for cooperation with a corresponding locking recess (not shown) disposed in the opposite door, so that for the safety of the operator the door assembly 110 may be securely locked in a closed position.

Within the central opening 116 and in-between the tong plates 106, 108 is disposed a cage plate assembly 120 that includes a rotary gear 122. The throat 118 may further extend into an opening of the cage plate assembly 120. Moreover, the cage plate assembly 120 may rotate 360 degrees within the central opening 116.

Figure 1C:
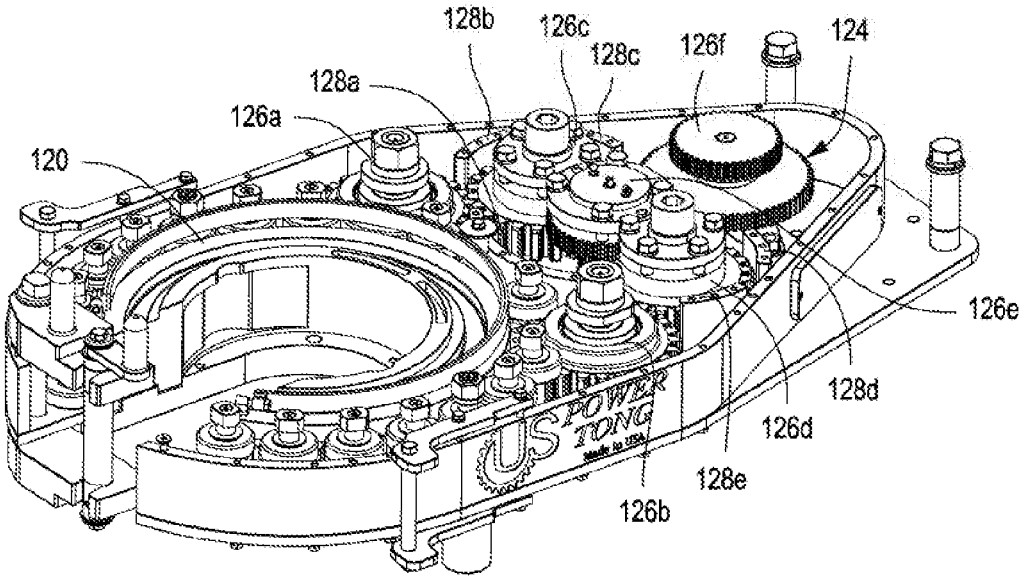
FIG. 1C shows a perspective top view of the uncovered power tong in FIG. 1A and its inner components.
Figure 1D:
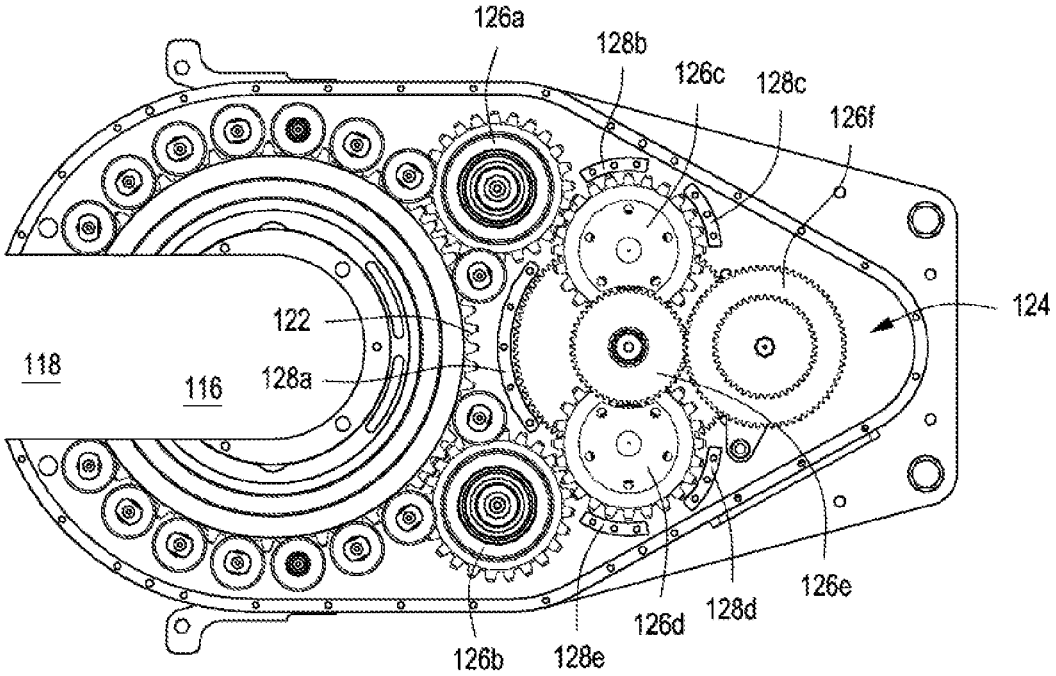
FIG. 1D shows a top plan view of FIG. 1C.
Figure 2:
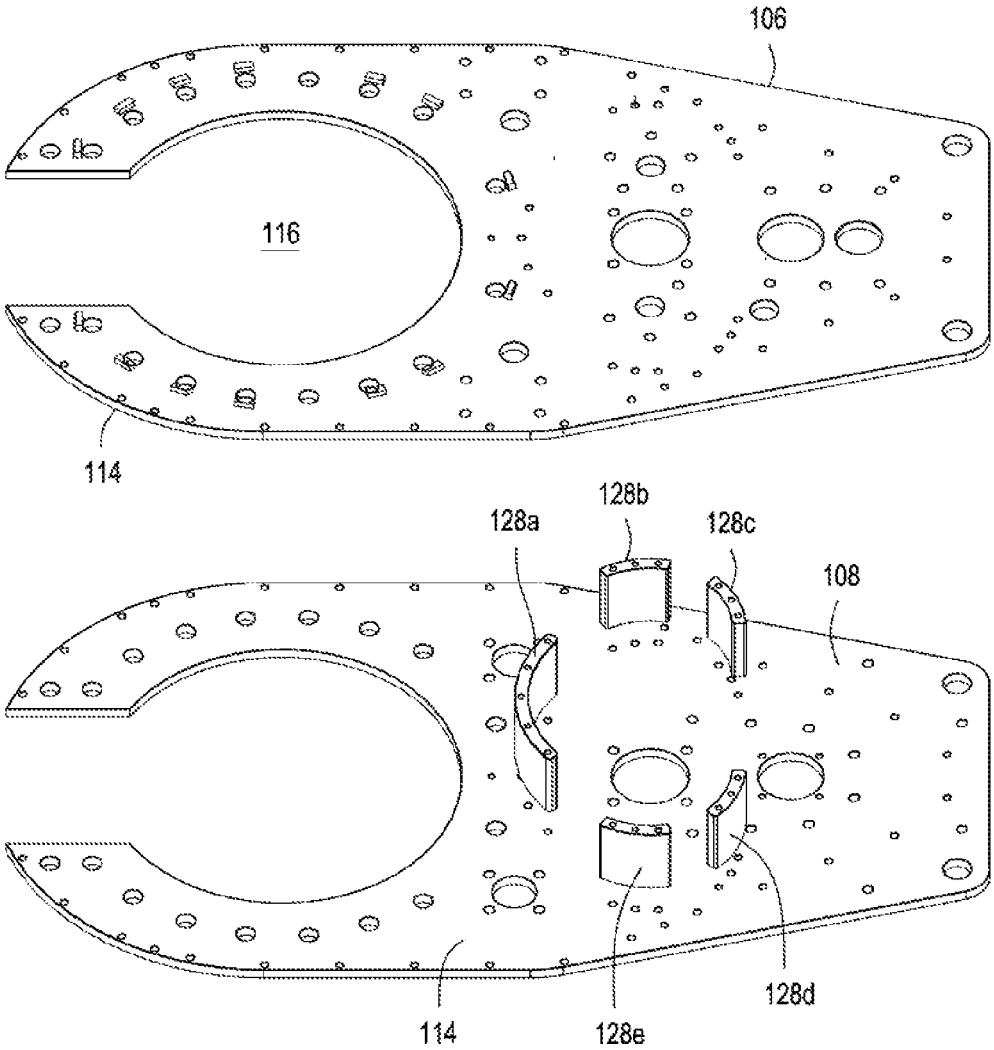
FIG. 2 shows a simplified, exploded view of FIG. 1B emphasizing the position of a set of struts relative to an upper tong plate and a lower tong plate.

Rotation of the rotary gear 122 is caused by a transmission gear train 124 that may extend between a hydraulic motor (not shown) and the rotary gear 122, as seen in FIG. 1C and FIG. 1D where the upper tong plate 106 has been removed to show the inner components of the power tong 102. On the outer circumference of the rotary gear 122 (except for the throat 118) are a series of teeth that may engage with teeth on corresponding gear assemblies 126*a*, 126*b* of the gear train 124. All gear assemblies 126 in the gear train 124 have teeth and may include one or more gears, a gear shaft, one or more spacers, one or more gear shaft retainers, and one or more threaded assemblies.

The gear train 124 includes one or more gear assemblies 126. Depending on its subcomponents and position in a gear train 122, a gear assembly 126 may have different designations in different versions. Turning to an example in FIG. 1D, the gear train 124 includes two rotary idler gear assemblies 126*a*, 126*b*, two pinion idler gear assemblies 126*c*, 126*d*, one pinion gear assembly 126*e*, and one clutch gear assembly 126*f*. Referencing the rotary gear 122 as a starting point, the gear train 124 may begin at rotary idler gear assemblies 126*a*. 126*b*. Each gear assembly 126*a*, 126*b* may engage a pinion gear assembly 126*c*, 126*d*, respectively. The pinion idler gear assemblies 126*c*, 1264 may together engage the pinion gear assembly 126*e*. The pinion gear assembly 126*e* may engage the clutch gear assembly 126*f* which may receive torque from a hydraulic motor (not shown). Each gear assembly 126 may be removably coupled to either the upper tong plate 106 or lower tong plate 108, or both.

Although FIG. 1C and FIG. 1D show versions of gear trains comprising six gear assemblies 126, alternative versions may include a gear train 124 having a varying number of gear assemblies 126 of varying radiuses. Moreover, the combination and position of the aforementioned gear assemblies 126 in different versions may vary to produce different gear trains 124, as long as each resultant gear train 124 may properly drive rotation of the rotary gear 122.

The gear trains of the disclosed power tongs may be used for high torque operations. Thus, as illustrated in the views C-D of FIG. 1, one or more struts 128 may be disposed within spaces adjacent to the gear assemblies 126 of the gear train 124 to reinforce the body of the power tong 102. Referring to FIG. 2, the struts 128-*e* may be disposed between inner surfaces 114 of the tong plates 106, 108 and removably coupled to the inner surface 114 of either the upper tong plate 106 or lower tong plate 108, or both.

The views A, B, and C of each FIG. 3-12 illustrate, respectively, pre-assembled, assembled, and disassembled versions of different gear assemblies 126 that may be used in the gear train 124.

Figure 3A:
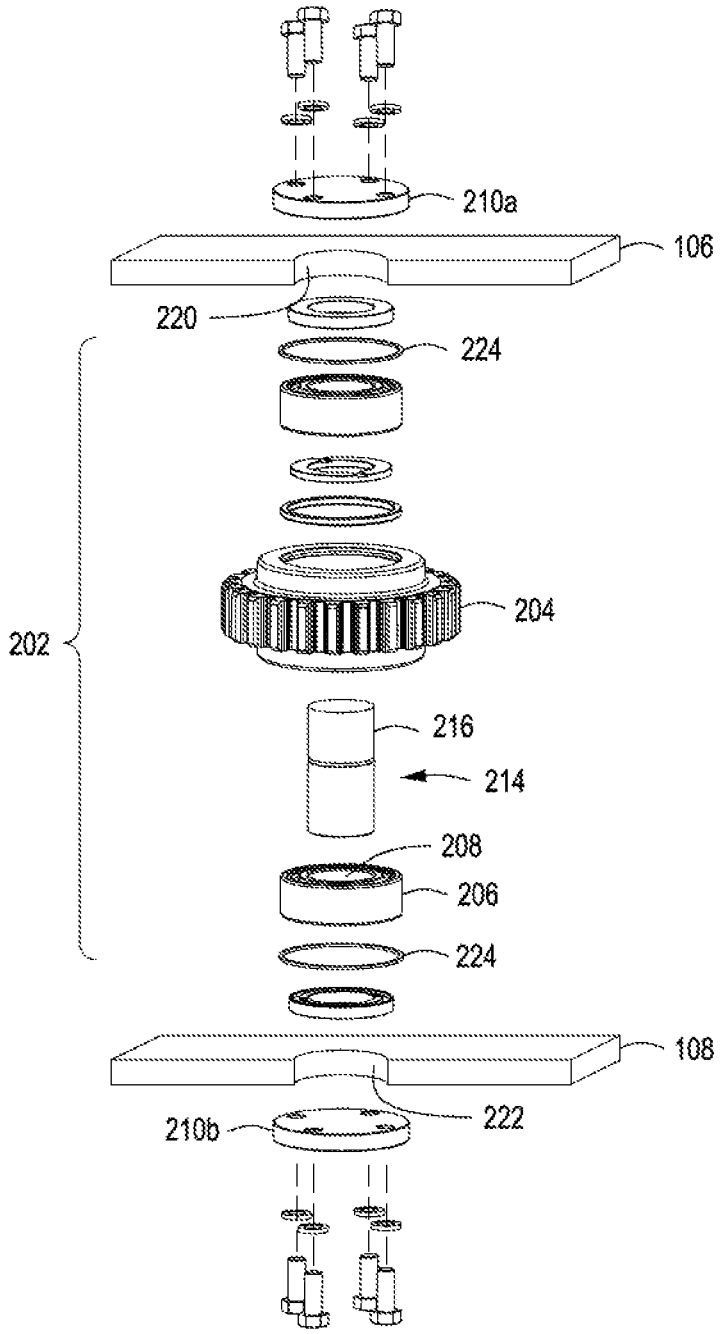
FIG. 3A shows an exploded view of a version of a gear assembly.
Figure 3B:
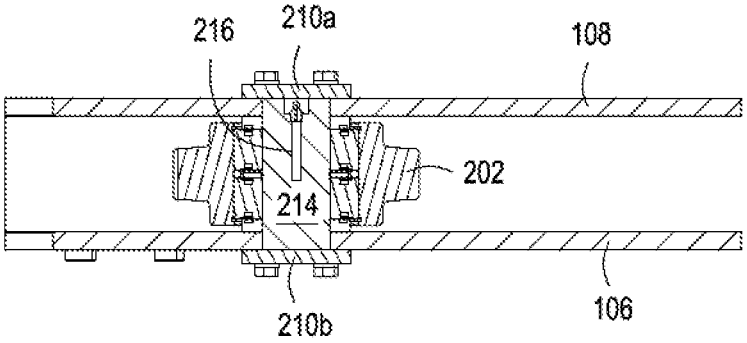
FIG. 3B shows a cross sectional view of the gear assembly of FIG. 3A assembled and installed between an upper tong plate and a lower tong plate of a power tong.

The views of FIG. 3 show an example of a gear assembly 126. Referring to the exploded view of FIG. 3A, the gear assembly 126 includes a cylindrical gear 202, a gear shaft 214, and one or more shaft retainers 210. Referring to FIG. 3B, the gear 202 may by slidably and rotatably connected to a non-threaded portion 216 of the gear shaft 214. Tong plate apertures 220, 222 may each slidably receive a respective end of the non-threaded portion 216 of the gear shaft 214. A shaft retainer 210 may be mounted over each tong plate aperture 220, 222, with the inner surface of the shaft retainer 210 removably coupled to an outer surface 112 of the tong plate 106, 108 corresponding to each aperture 220, 222. Additionally, the inner surface of each shaft retainer 210 may be abutted against the end of the non-threaded portion 216 received in the aperture 220, 222 correspondingly covered by the shaft retainer 210.

Figure 3C:
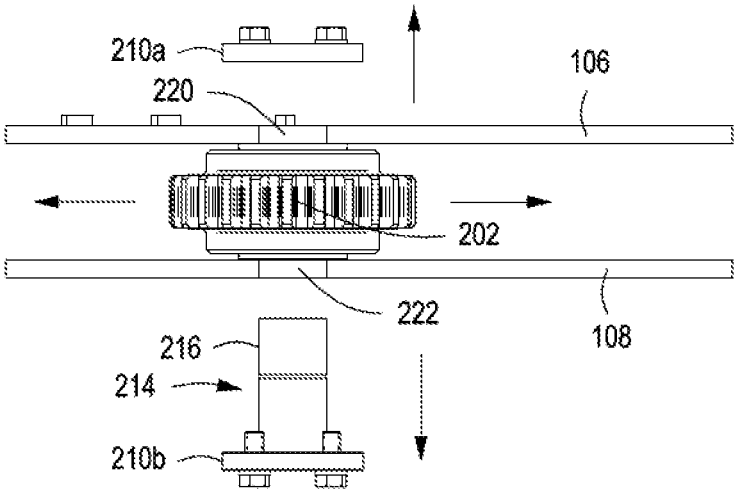
FIG. 3C shows an exploded view of the gear assembly of FIG. 3B disassembled and capable of being removed from a power tong without removal of the upper tong plate.

As shown in FIG. 3B, the tong plate apertures 220, 222 may be sized to have a diameter slightly larger than that of the non-threaded portion 216 to provide for a slip fit when receiving the non-threaded portion 216. Thus, the gear shaft may be capable of egress and ingress through either of the apertures 220, 222 during repair operations, as shown in FIG. 3C.

Figure 4A:
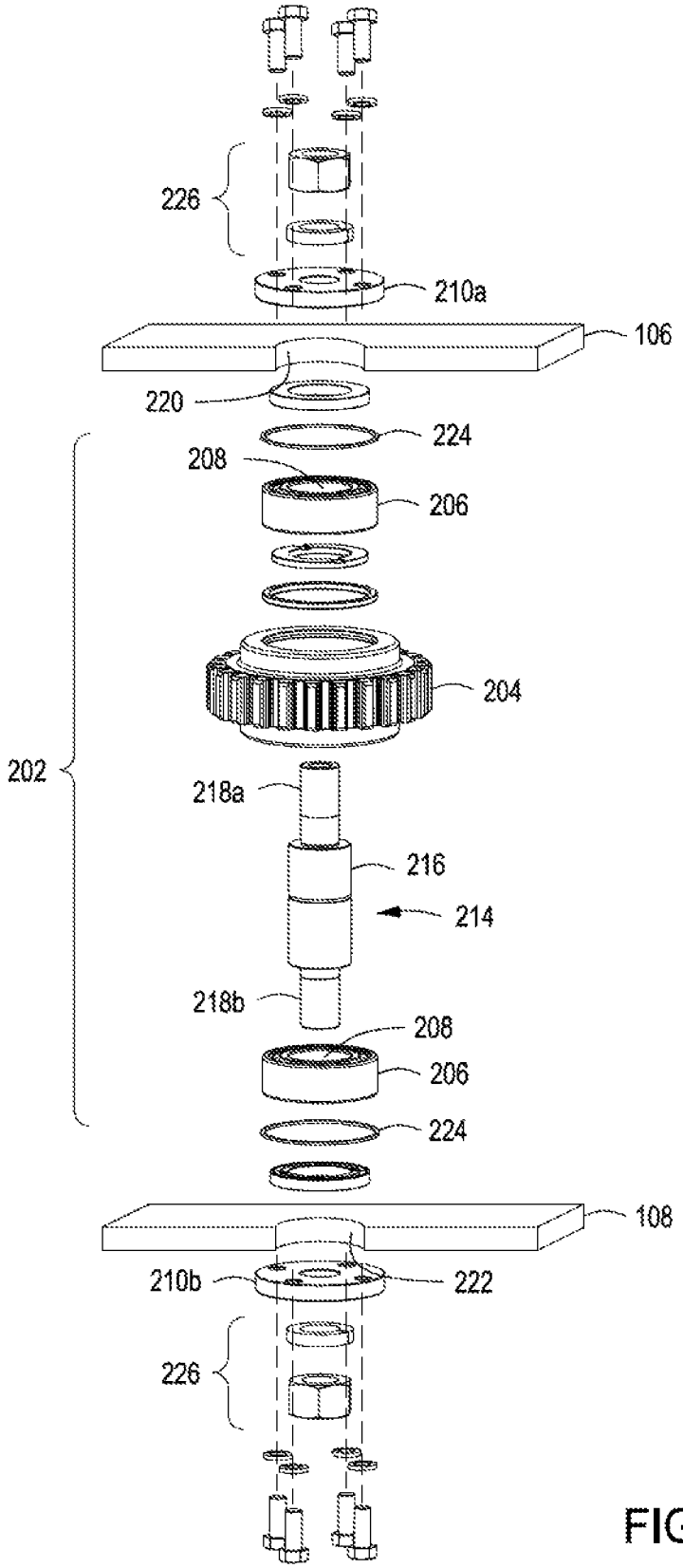
FIG. 4A shows an exploded view of a version of a gear assembly.
Figure 4B:
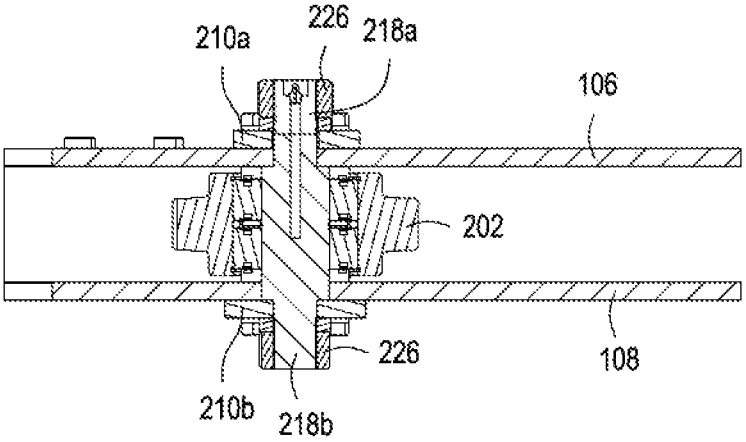
FIG. 4B shows a cross sectional view of the gear assembly of FIG. 4A assembled and installed between an upper tong plate and a lower tong plate of a power tong.

The views of FIG. 4 show a second example of a gear assembly 126. Referring to the exploded view of FIG. 4A, the gear assembly 126 includes a cylindrical gear 202, a gear shaft 214, one or more shaft retainers 210, and one or more threaded assemblies 226. Referring to FIG. 4B, the gear 202 may by slidably and rotatably connected to a non-threaded portion 216 of the gear shaft 214. Tong plate apertures 220, 222 may each slidably receive a respective end of the non-threaded portion 216 of the gear shaft 214. A shaft retainer 210 may be mounted over each tong plate aperture 220, 222, with the inner surface of the shaft retainer 210 removably coupled to an outer surface 112 of a tong plate 106, 108 corresponding to each aperture 220, 222. The inner surface of each shaft retainer 210 may be abutted against the end of the non-threaded portion 216 received in the aperture 220, 222 correspondingly covered by the shaft retainer 210. Additionally, threaded portions 218*a, b* of the gear shaft 214 may each extend through a respective aperture 212*a, b* of each shaft retainer 210. A threaded assembly 226 may be mated with each threaded portion 218 and disposed against the outer surface of each shaft retainer 210.

Figure 4C:
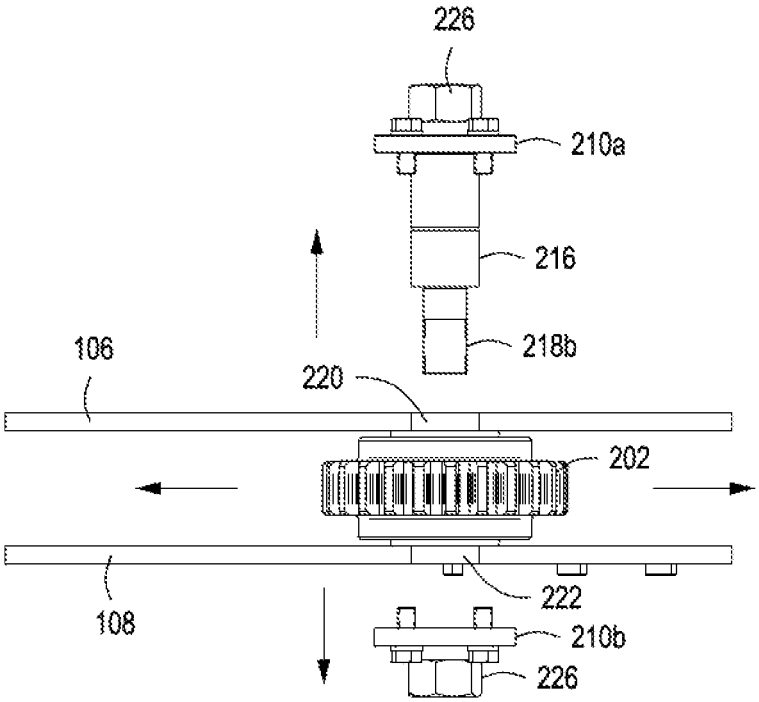
FIG. 4C shows an exploded view of the gear assembly of FIG. 4B disassembled and capable of being removed from a power tong without removal of the upper tong plate.

As shown in FIG. 4B, the tong plate apertures 220, 222 may be sized to have a diameter slightly larger than that of the non-threaded portion 216 to provide for a slip fit when receiving the non-threaded portion 216. Thus, the gear shaft 214 may be capable of egress and ingress through either of the apertures 220, 222 during repair operations, as shown in FIG. 4C.

Figure 5A:
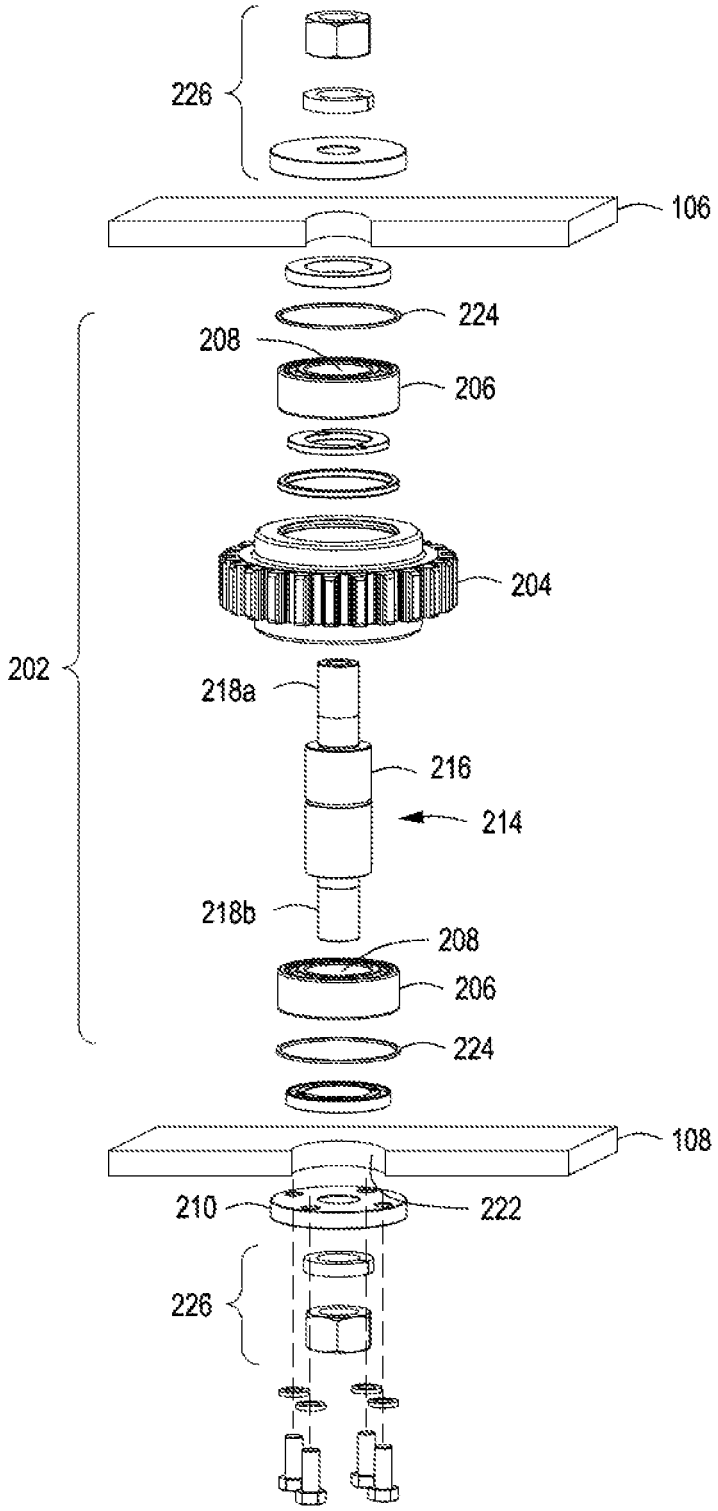
FIG. 5A shows an exploded view of a version of a gear assembly.
Figure 5B:
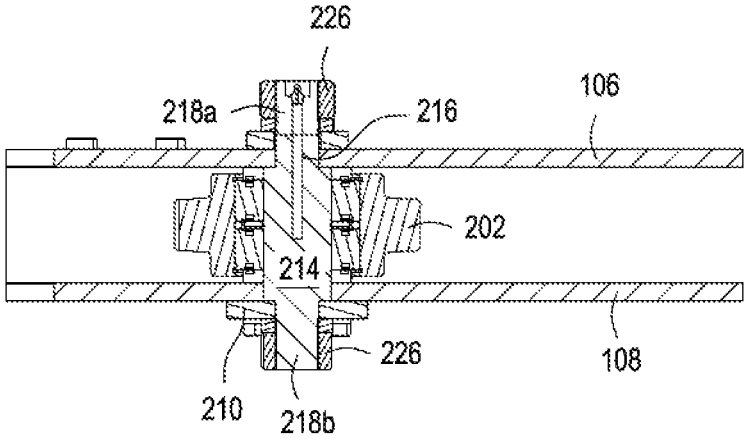
FIG. 5B shows a cross sectional view of the gear assembly of FIG. 5A assembled and installed between an upper tong plate and a lower tong plate of a power tong.

The views of FIG. 5 show a third example of a gear assembly 126. Referring to the exploded view of FIG. 5A, the gear assembly 126 includes a cylindrical gear 202, a gear shaft 214, one or more shaft retainers 210, and one or more threaded assemblies 226. Referring to FIG. 5B, the gear 202 may by slidably and rotatably connected to the non-threaded portion 216 of the gear shaft 214. An aperture 222 of a lower tong plate 108 may slidably receive a first end of a non-threaded portion 216 of the gear shaft 214. An aperture 220 of an upper tong plate 106 may receive, and through which extends, a threaded portion 218*a* of the gear shaft 214. A shaft retainer 210 may be mounted over the lower tong plate aperture 222 and an inner surface of the shaft retainer 210 may be removably coupled to the outer surface 112 of the lower tong plate 108. The inner surface of the shaft retainer 210 may be abutted against the end of the non-threaded portion 216 received in the aperture 222 correspondingly covered by the shaft retainer 210. Additionally, a shaft retainer aperture 212 of the shaft retainer 210 may receive, and through which extends, a threaded portion 218*b* of the gear shaft 214. A threaded assembly 226 may be mated with each threaded portion 218 and disposed against the outer surface of the upper tong plate 106 or the shaft retainer 210.

Figure 5C:
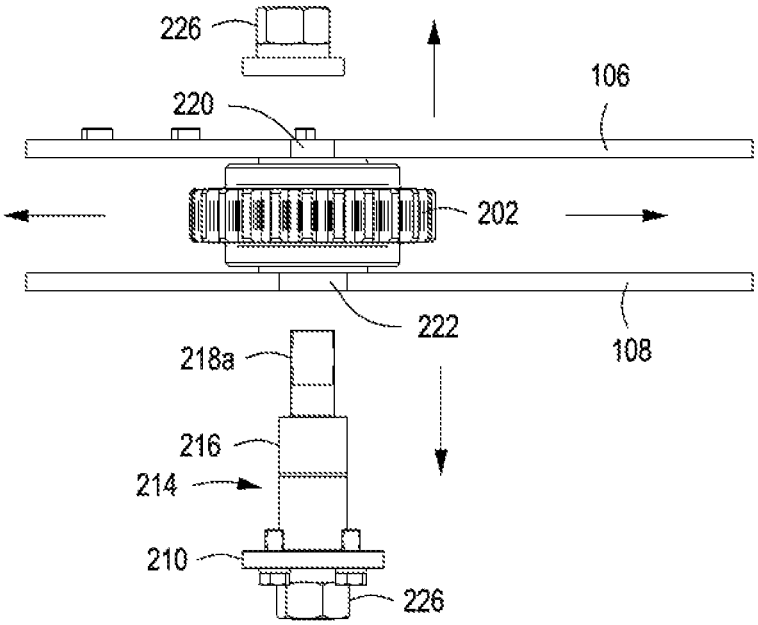
FIG. 5C shows an exploded view of the gear assembly of FIG. 5B disassembled and capable of being removed from a power tong without removal of the upper tong plate.

As shown in FIG. 5B, the lower tong plate aperture 222 may be sized to have a diameter slightly larger than that of the non-threaded portion 216 to provide for a slip fit when receiving the non-threaded portion 216. Thus, the gear shaft may be capable of egress and ingress through the aperture 220 during repair operations, as shown in FIG. 5C.

Figure 6A:
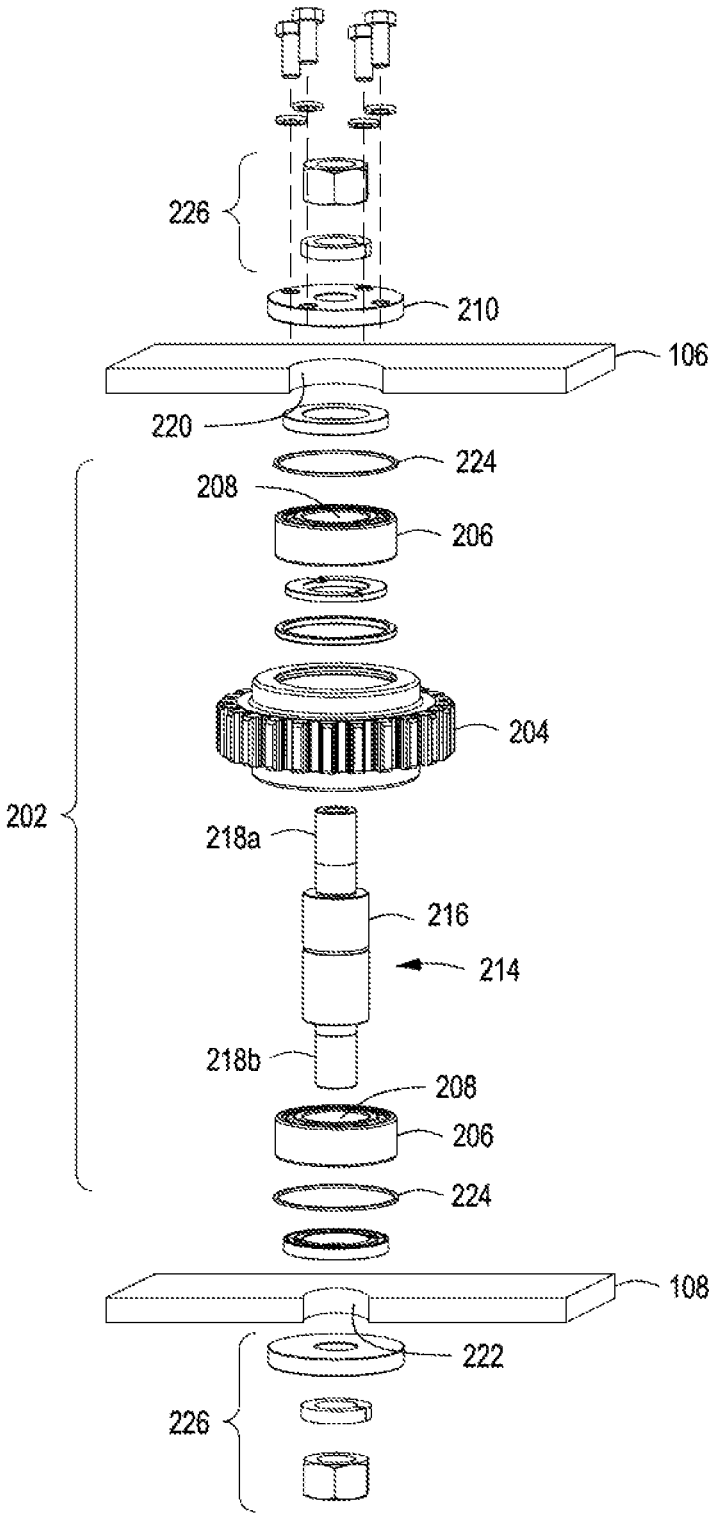
FIG. 6A shows an exploded view of a version of a gear assembly.
Figure 6B:
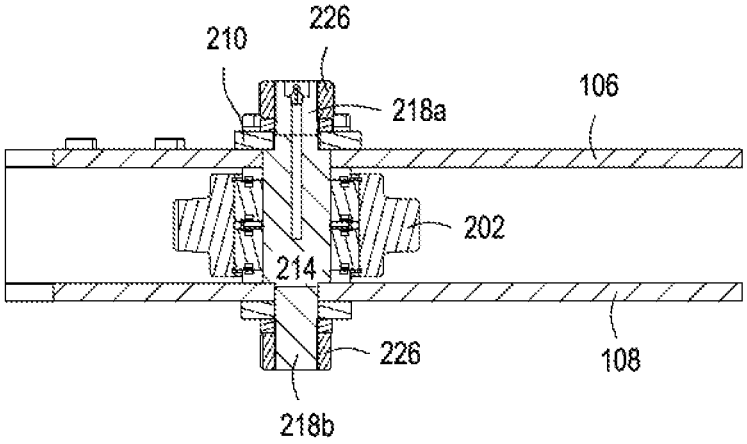
FIG. 6B shows a cross sectional view of the gear assembly of FIG. 6A assembled and installed between an upper tong plate and a lower tong plate of a power tong.

The views of FIG. 6 show a fourth example of a gear assembly 126. Referring to the exploded view of FIG. 6A, the gear assembly 126 includes a cylindrical gear 202, a gear shaft 214, one or more shaft retainers 210, and one or more threaded assemblies 226. Referring to FIG. 6B, the gear 202 may by slidably and rotatably connected to a non-threaded portion 216 of the gear shaft 214. An aperture 220 of an upper tong plate 106 may slidably receive a first end of a non-threaded portion 216 of the gear shaft 214. An aperture 220 of a lower tong plate 108 may receive, and through which extends, a threaded portion 218*b* of the gear shaft 214. A shaft retainer 210 may be mounted over the upper tong plate aperture 220 and removably coupled to the outer surface 112 of upper tong plate 106. The inner surface of the shaft retainer 210 may be abutted against the end of the non-threaded portion 216 received in the aperture 220 correspondingly covered by the shaft retainer 210. A shaft retainer aperture 212 of the shaft retainer 210 may receive, and through which extends, a threaded portion 218*a* of the gear shaft 214. A threaded assembly 226 may be mated with each threaded portion 218 and disposed against the outer surface of the upper tong plate 106 or the shaft retainer 210.

Figure 6C:
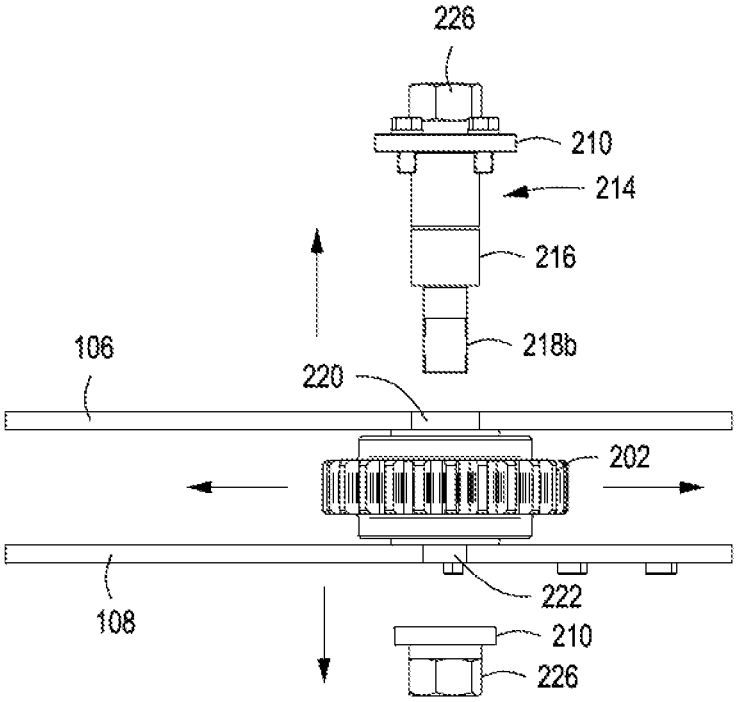
FIG. 6C shows an exploded view of the gear assembly of FIG. 6B disassembled and capable of being removed from a power tong without removal of the upper tong plate.

As shown in FIG. 6B, the upper tong plate aperture 220 may be sized to have a diameter slightly larger than that of the non-threaded portion 216 to provide for a slip fit when receiving the non-threaded portion 216. Thus, the gear shaft may be capable of egress and ingress through the aperture 220 during repair operations, as shown in FIG. 6C.

Figure 7A:
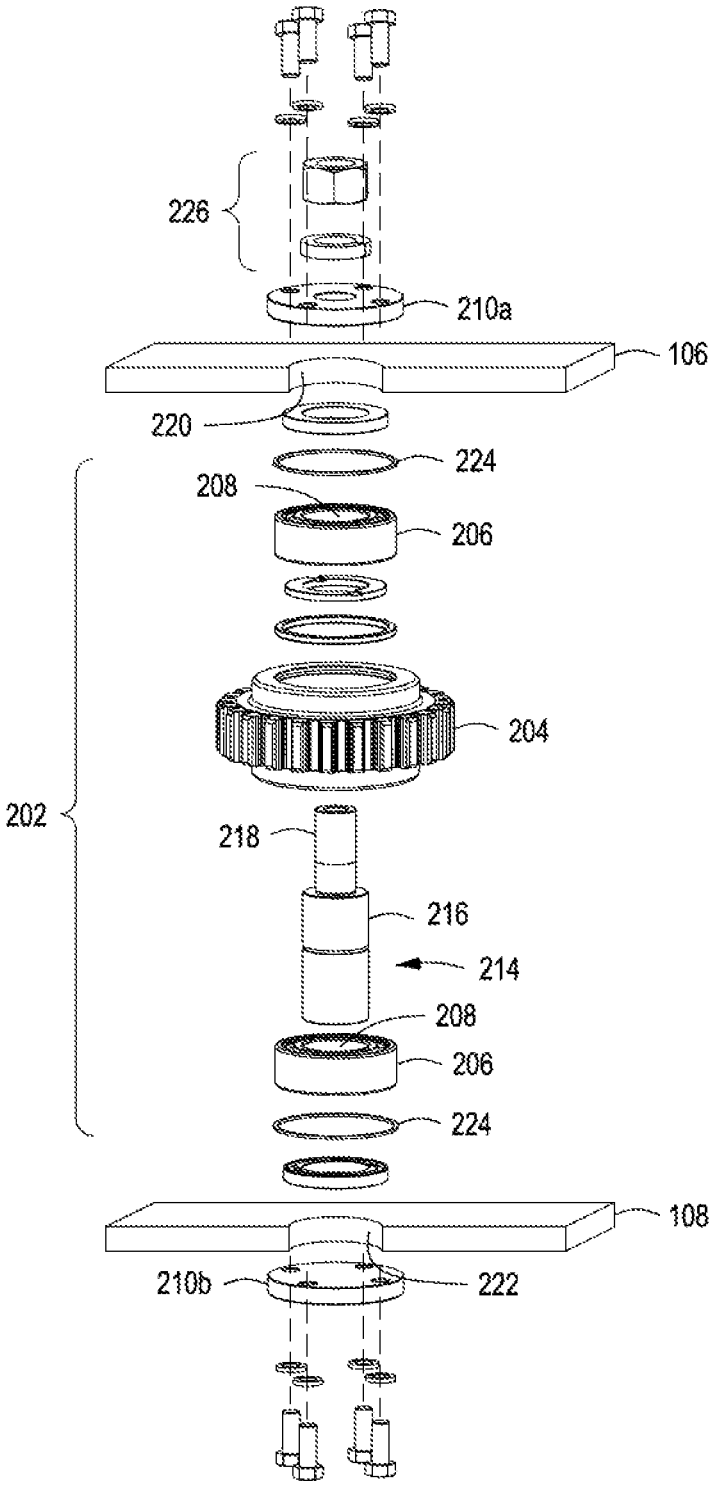
FIG. 7A shows an exploded view of a version of a gear assembly.
Figure 7B:
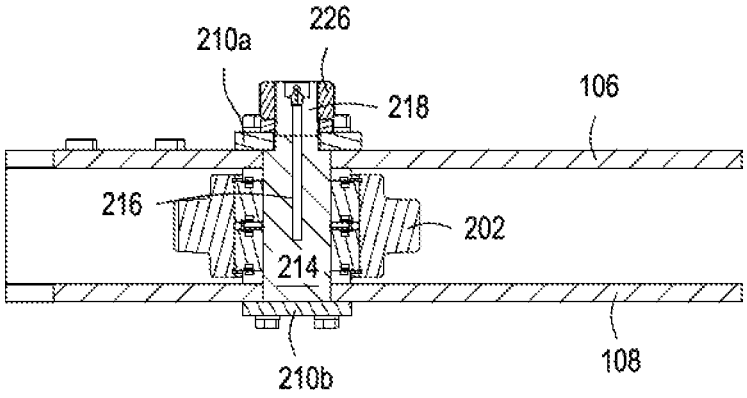
FIG. 7B shows a cross sectional view of the gear assembly of FIG. 7A assembled and installed between an upper tong plate and a lower tong plate of a power tong.

The views of FIG. 7 show a fifth example of a gear assembly 126. Referring to the exploded view of FIG. 7A, the gear assembly 126 includes a cylindrical gear 202, a gear shaft 214, one or more shaft retainers 210, and one or more threaded assemblies 226. Referring to FIG. 7B, the gear 202 may by slidably and rotatably connected to the non-threaded portion 216 of the gear shaft 214. Tong plate apertures 220, 222 may each slidably receive a respective end of the non-threaded portion 216 of the gear shaft 214. A shaft retainer 210 may be mounted over each tong plate aperture 220, 222, with the inner surface of the shaft retainer 210 removably coupled to an outer surface 112 of the tong plate 106, 108 corresponding to each aperture 220, 222. The inner surface of each shaft retainer 210 may be abutted against the end of the non-threaded portion 216 received in the aperture 220, 222 correspondingly covered by the shaft retainer 210. Additionally, a threaded portion 218 of the gear shaft 214 may extend through an aperture 212 of the upper shaft retainer 210*a*. A threaded assembly 226 may be mated with the threaded portion 218 and disposed against an outer surface of the upper shaft retainer 210*a*.

Figure 7C:
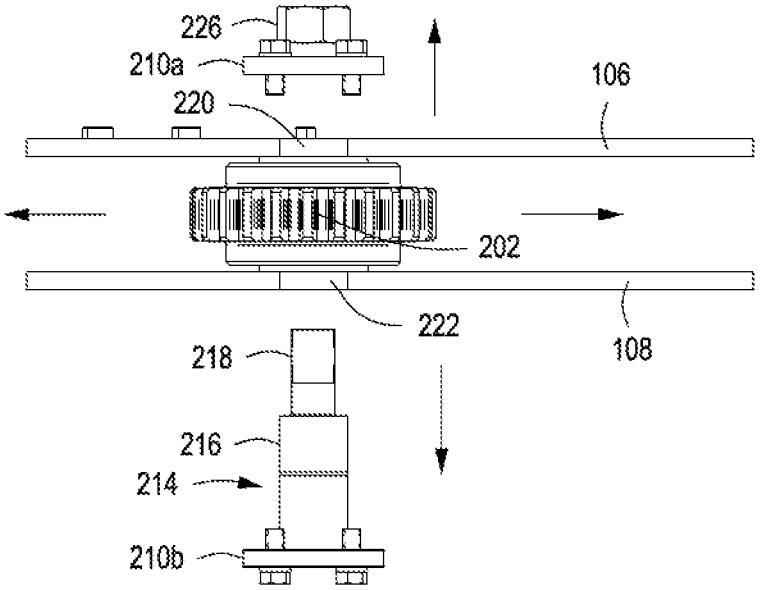
FIG. 7C shows an exploded view of the gear assembly of FIG. 7B disassembled and capable of being removed from a power tong without removal of the upper tong plate.

As shown in FIG. 7B, the tong plate apertures 220, 222 may be sized to have a diameter slightly larger than that of the non-threaded portion 216 to provide for a slip fit when receiving the non-threaded portion 216. Thus, the gear shaft 217 may be capable of egress and ingress through either of the apertures 220, 222 during repair operations, as shown in FIG. 7C.

Figure 8A:
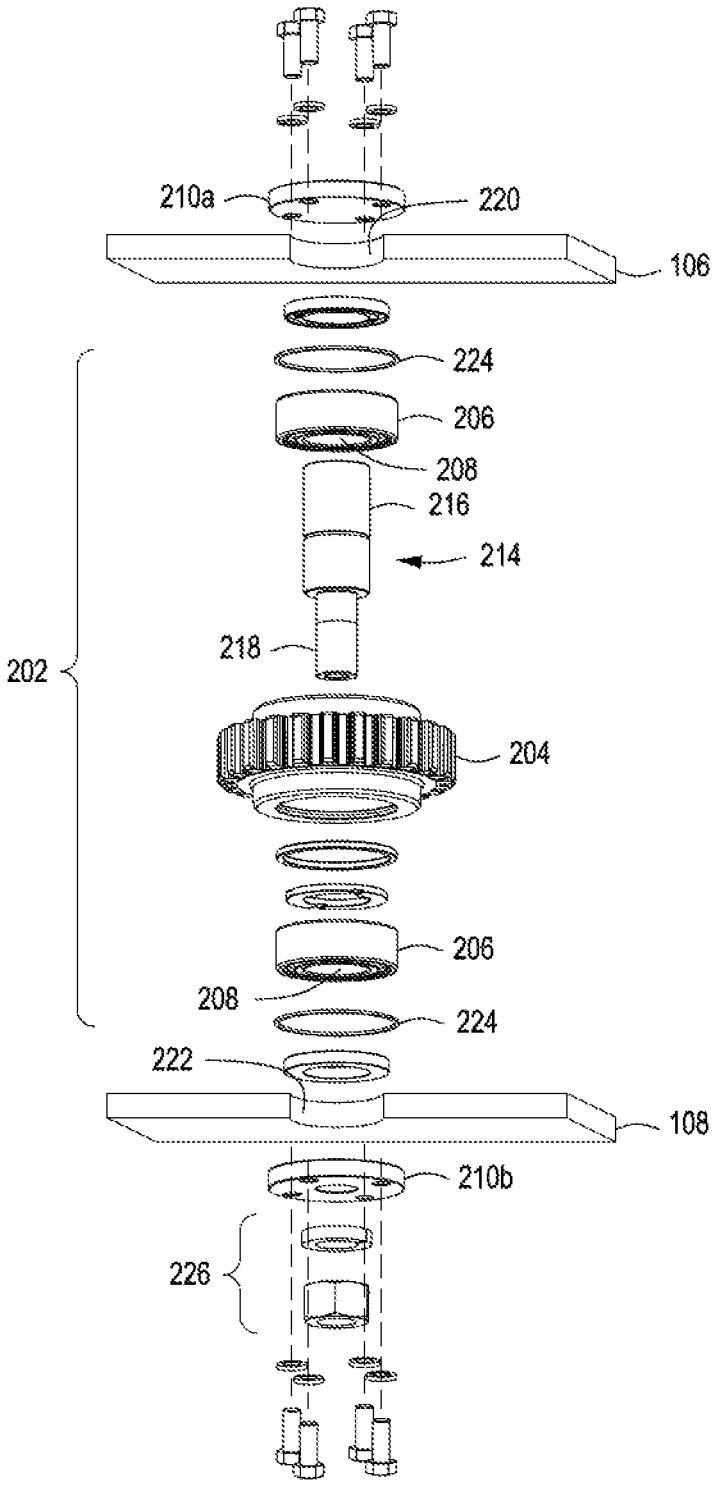
FIG. 8A shows an exploded view of a version of a gear assembly.
Figure 8B:
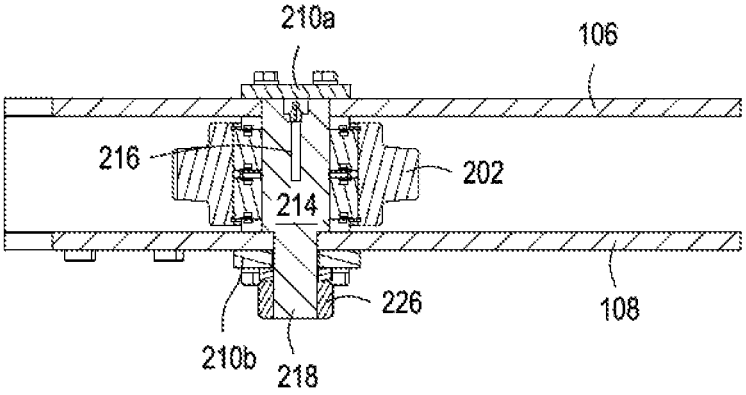
FIG. 8B shows a cross sectional view of the gear assembly of FIG. 8A assembled and installed between an upper tong plate and a lower tong plate of a power tong.

The views of FIG. 8 show a sixth example of a gear assembly 126. Referring to the exploded view of FIG. 8A, the gear assembly 126 includes a cylindrical gear 202, a gear shaft 214, one or more shaft retainers 210, and one or more threaded assemblies 226. Referring to FIG. 8B, the gear 202 may by slidably and rotatably connected to the non-threaded portion 216 of the gear shaft 214. Tong plate apertures 220, 222 may each slidably receive a respective end of the non-threaded portion 216 of the gear shaft 214. A shaft retainer 210 may be mounted over each tong plate aperture 220, 222, with the inner surface of the shaft retainer 210 removably coupled to an outer surface 112 of a tong plate 106, 108 corresponding to each aperture 220, 222. The inner surface of each shaft retainer 210 may be abutted against the end of the non-threaded portion 216 received in the aperture 220, 222 correspondingly covered by the shaft retainer 210. Additionally, a threaded portion 218 of the gear shaft 214 may extend through an aperture 212 of the lower shaft retainer 210*b*. A threaded assembly 226 may be mated with the threaded portion 218 and disposed against the outer surface of the lower shaft retainer 210*b*.

Figure 8C:
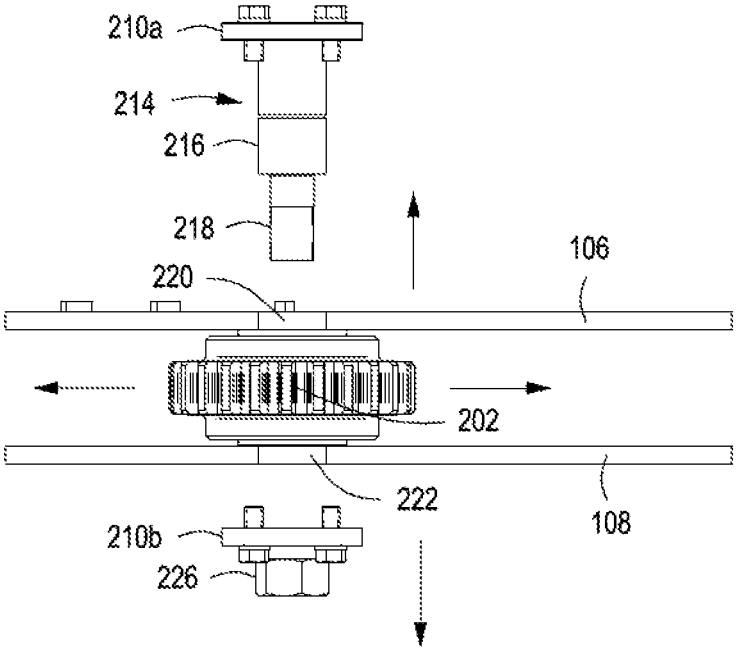
FIG. 8C shows an exploded view of the gear assembly of FIG. 8B disassembled and capable of being removed from a power tong without removal of the upper tong plate.

As shown in FIG. 8B, the tong plate apertures 220, 222 may be sized to have a diameter slightly larger than that of the non-threaded portion 216 to provide for a slip fit when receiving the non-threaded portion 216. Thus, the gear shaft 214 may be capable of egress and ingress through either of the apertures 220, 222 during repair operations, as shown in FIG. 8C.

Figure 9A:
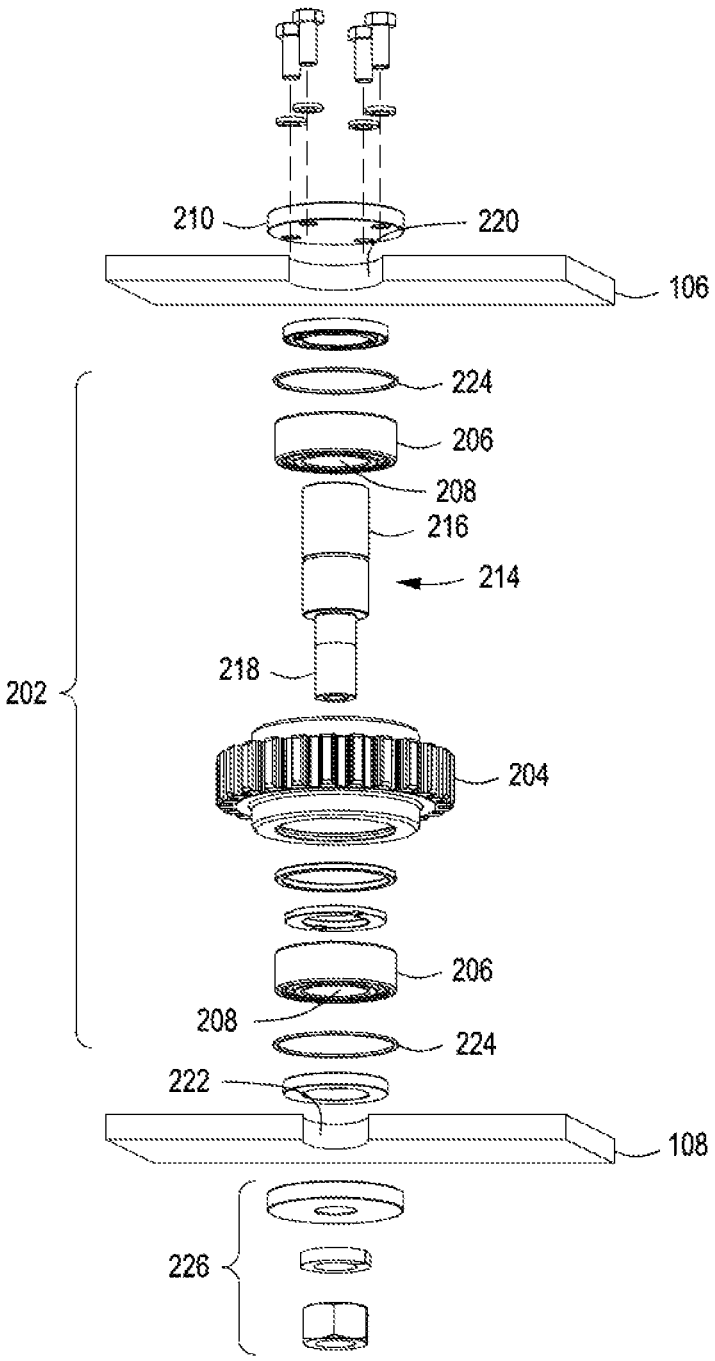
FIG. 9A shows an exploded view of a version of a gear assembly.
Figure 9B:
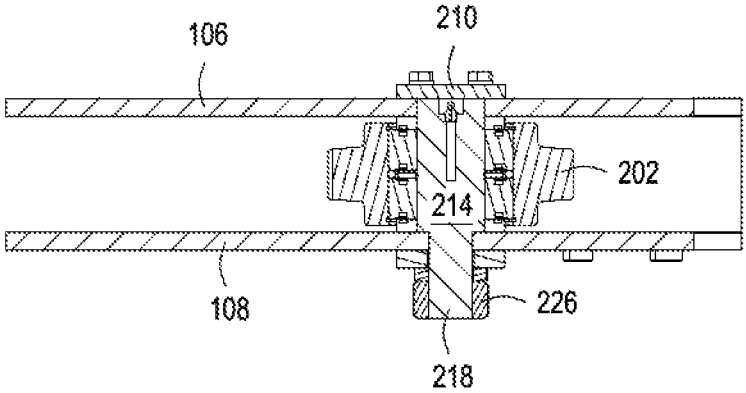
FIG. 9B shows a cross sectional view of the gear assembly of FIG. 9A assembled and installed between an upper tong plate and a lower tong plate of a power tong.

The views of FIG. 9 show a seventh example of a gear assembly 126. Referring to the exploded view of FIG. 9A, the gear assembly 126 includes a cylindrical gear 202, a gear shaft 214, one or more shaft retainers 210, and one or more threaded assemblies 226. Referring to FIG. 9B, the gear 202 may by slidably and rotatably connected to the non-threaded portion 216 of the gear shaft 214. An upper aperture 220 of an upper tong plate 106 may slidably receive a first end of a non-threaded portion 216 of the gear shaft 214. An upper shaft retainer 210 may be mounted over the upper tong plate aperture 220 and removably coupled to the outer surface 112 of the upper tong plate 106. The inner surface of the shaft retainer 210 may be abutted against the end of the non-threaded portion 216 received in the aperture 220 correspondingly covered by the shaft retainer 210. Additionally a lower aperture 222 of a lower tong plate 108 may receive, and through which extends, a lower threaded portion 218 of the gear shaft 214. A threaded assembly 226 may be mated with the lower threaded portion 218 and disposed against the outer surface 112 of the lower tong plate 108.

Figure 9C:
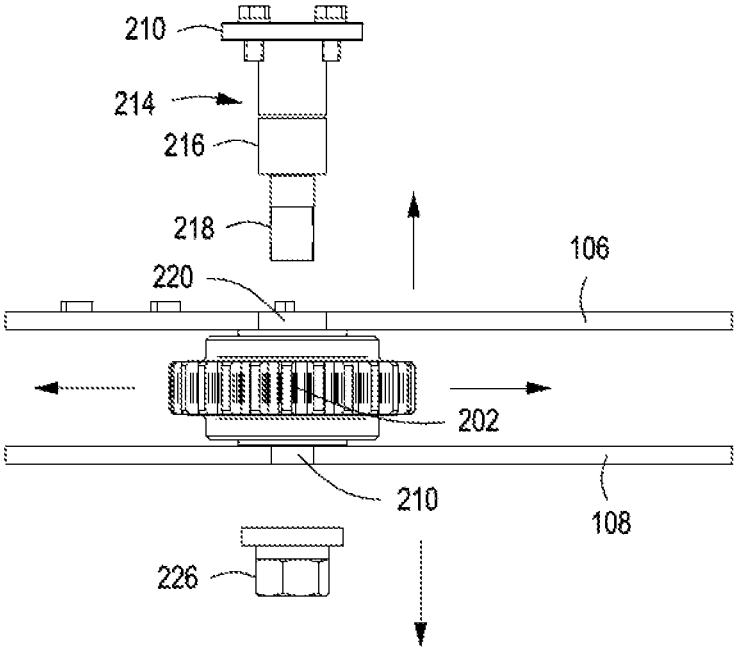
FIG. 9C shows an exploded view of the gear assembly of FIG. 9B disassembled and capable of being removed from a power tong without removal of the upper tong plate.

As shown in FIG. 9B, the diameter of the upper tong plate aperture 220 may be sized to have a diameter slightly larger than that of the non-threaded portion 216 to provide for a slip fit when receiving the non-threaded portion 216. Thus, the gear shaft may be capable of egress and ingress through the aperture 220 during repair operations, as shown in FIG. 9C.

Figure 10A:
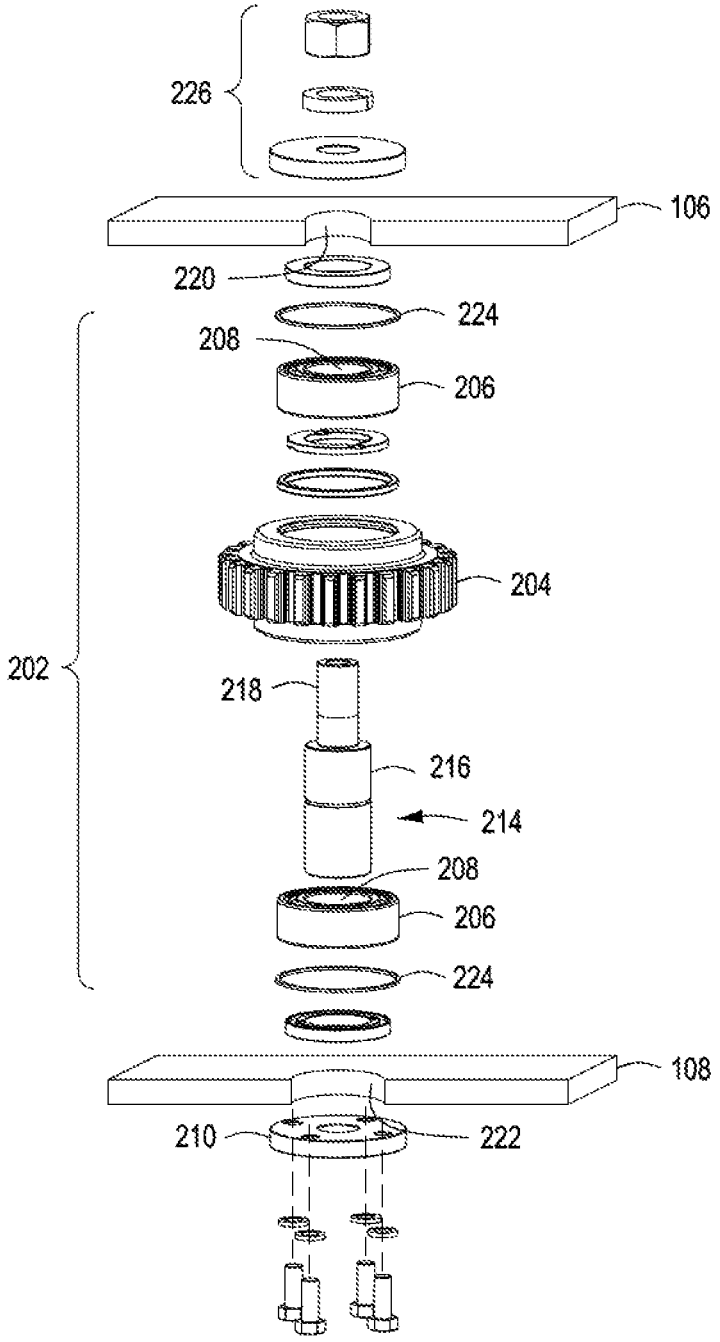
FIG. 10A shows an exploded view of a version of a gear assembly.
Figure 10B:
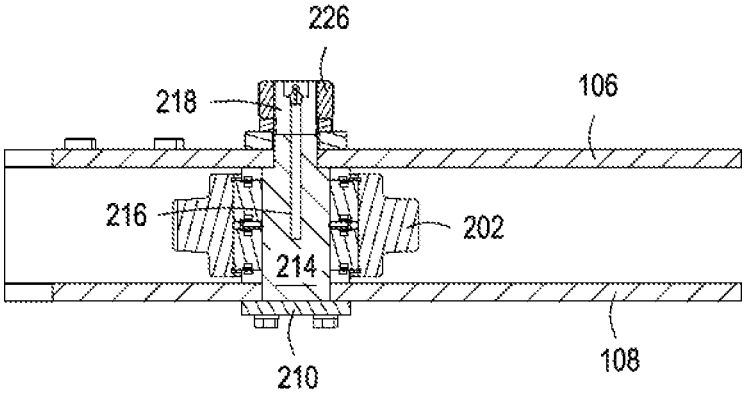
FIG. 10B shows a cross sectional view of the gear assembly of FIG. 10A assembled and installed between an upper tong plate and a lower tong plate of a power tong.

The views of FIG. 10 show an eighth example of a gear assembly 126. Referring to the exploded view of FIG. 10A, the gear assembly 126 includes a cylindrical gear 202, a gear shaft 214, one or more shaft retainers 210, and one or more threaded assemblies 226. Referring to FIG. 10B, the gear 202 may by slidably and rotatably connected to the non-threaded portion 216 of the gear shaft 214. An upper aperture 220 of the upper tong plate 106 may receive, and through which extends, an upper threaded portion 218 of the gear shaft 214. A threaded assembly 226 may be mated with the lower threaded portion 218 and disposed against an outer surface 112 of the lower tong plate 108. Additionally, an aperture 222 of a lower tong plate 108 may slidably receive a first end of a non-threaded portion 216 of the gear shaft 214. A lower shaft retainer 210 may be mounted over the lower tong plate aperture 222 and removably coupled to the outer surface 112 of the lower tong plate 108. The inner surface of the shaft retainer 210 may be abutted against the end of the non-threaded portion 216 received in the aperture 222 correspondingly covered by the shaft retainer 210.

Figure 10C:
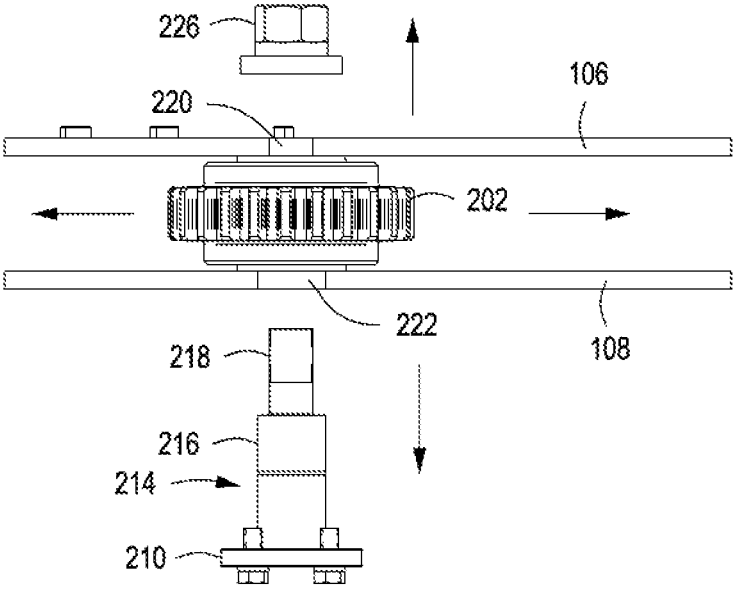
FIG. 10C shows an exploded view of the gear assembly of FIG. 10B disassembled and capable of being removed from a power tong without removal of the upper tong plate.

As shown in FIG. 10B, the lower tong plate aperture 222 may be sized to have a diameter slightly larger than that of the non-threaded portion 216 to provide for a slip fit when receiving the non-threaded portion 216. Thus, the gear shaft may be capable of egress and ingress through the aperture 222 during repair operations, as shown in FIG. 10C.

Figure 11A:
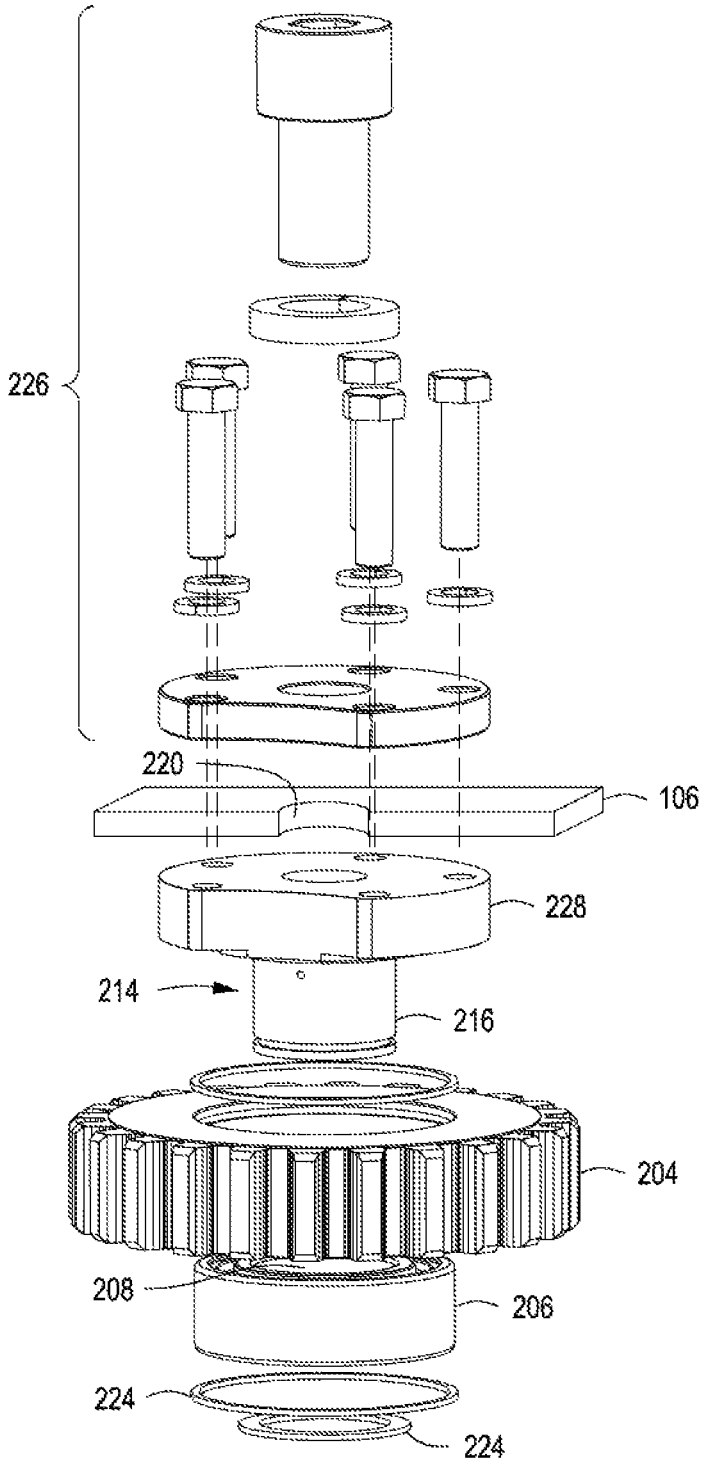
FIG. 11A shows an exploded view of a version of a gear assembly.
Figure 11B:
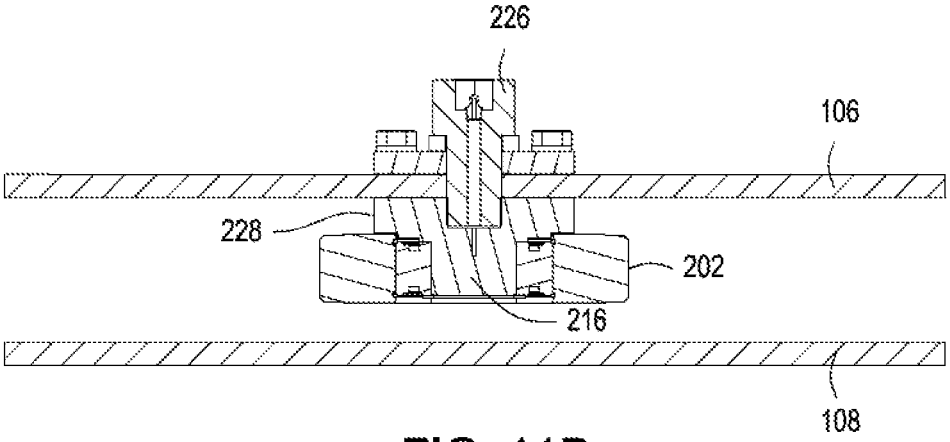
FIG. 11B shows a cross sectional view of the gear assembly of FIG. HA assembled and installed between an upper tong plate and a lower tong plate of a power tong.
Figure 11C:
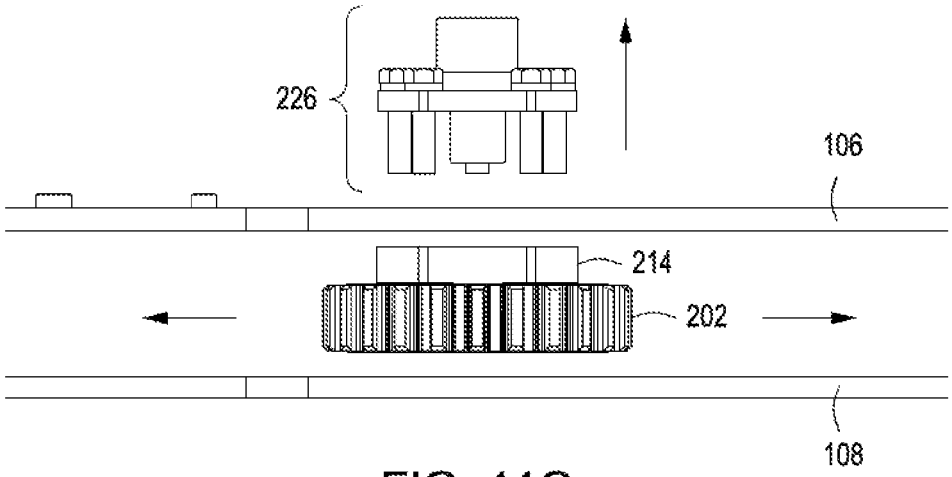
FIG. 11C shows an exploded view of the gear assembly of FIG. 11B disassembled and capable of being removed from a power tong without removal of the upper tong plate.

The views of FIG. 11 show a ninth example of a gear assembly 126. Referring to the exploded view of FIG. 11A, the gear assembly 126 includes a cylindrical gear 202, a gear shaft 214, and threaded assembly 226. Referring to FIG. 11B, the gear 202 may by slidably and rotatably connected to a non-threaded portion 216 of the gear shaft 214. The non-threaded portion 216 may be retained in the gear 202 by one or more snap rings 224 disposed on the non-threaded portion 216. A flange 228 of the gear shaft 214 may be mounted over the upper tong plate aperture 220 and removably coupled to the inner surface 114 of the upper tong plate 106. A threaded assembly 226 may extend through the upper tong plate aperture 220 and be mated to the flange 228 such that the threaded assembly may be disposed against the outer surface 112 of the upper tong plate 106.

Figure 12A:
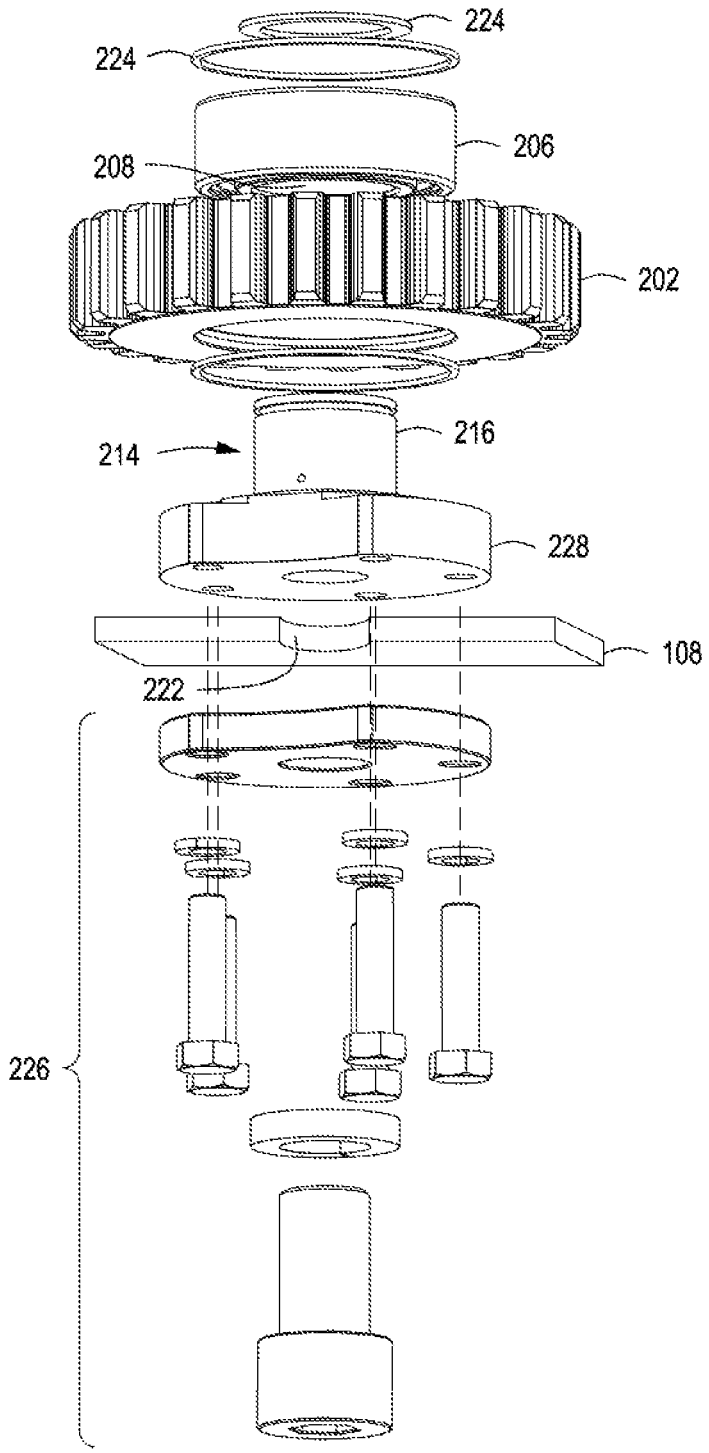
FIG. 12A shows an exploded view of a version of a gear assembly.
Figure 12B:
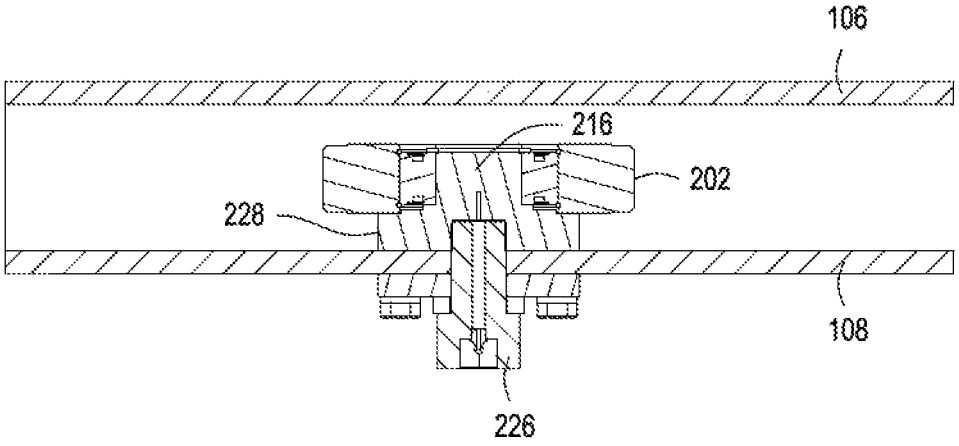
FIG. 12B shows a cross sectional view of the gear assembly of FIG. 12A assembled and installed between an upper tong plate and a lower tong plate of a power tong.
Figure 12C:
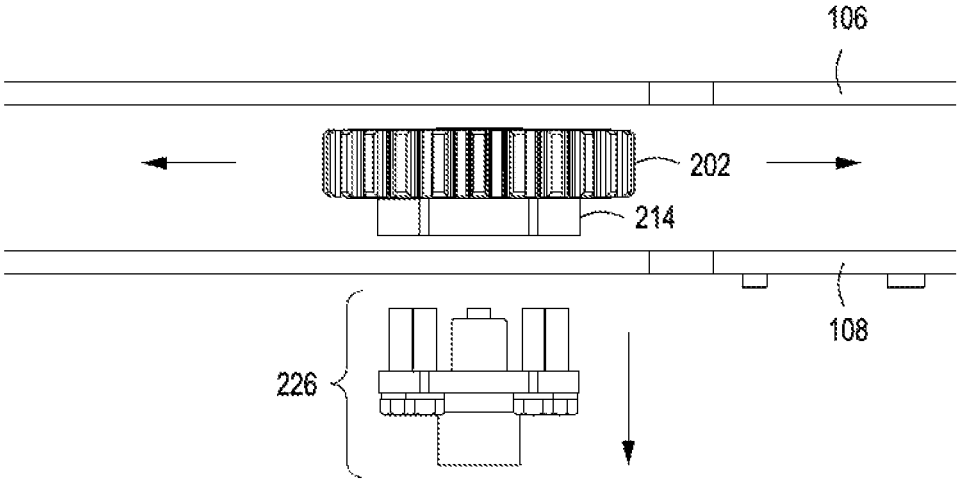
FIG. 12C shows an exploded view of the gear assembly of FIG. 12B disassembled and capable of being removed from a power tong without removal of the upper tong plate.

The views of FIG. 12 show a tenth example of a gear assembly 126. Referring to the exploded view of FIG. 12A, the gear assembly 126 includes a cylindrical gear 202, a gear shaft 214, and threaded assembly 226. Referring to FIG. 12B, the gear 202 may by slidably and rotatably connected to a non-threaded portion 216 of the gear shaft 214. The non-threaded portion 216 may be retained in the gear 202 by one or more snap rings 224 disposed on the non-threaded portion 216. The flange 228 of the gear shaft 214 may be mounted over the lower tong plate aperture 222 and removably coupled to the inner surface 114 of the lower tong plate 108. A threaded assembly 226 may extend through the upper tong plate aperture 222 and be mated to the flange 228 such that the threaded assembly may be disposed against the outer surface 112 of the lower tong plate 108.

During operation in the oil field, one or more gear assemblies in a power tong may require repair or replacement. Accordingly, the previously described gear assemblies and struts of the disclosed power tongs may be easily removed and replaced without removal of the upper tong plate. The views A-C of FIG. 13 illustrate a sequence for removing certain gear assemblies and struts without removing the upper tong plate 106. The views are shown without the upper tong plate 106 to visibly assist in describing the interactions of the inner component. However, it should be assumed that one is present in the course of component ingress into or egress from the power tong as described henceforth.

Figure 13A:
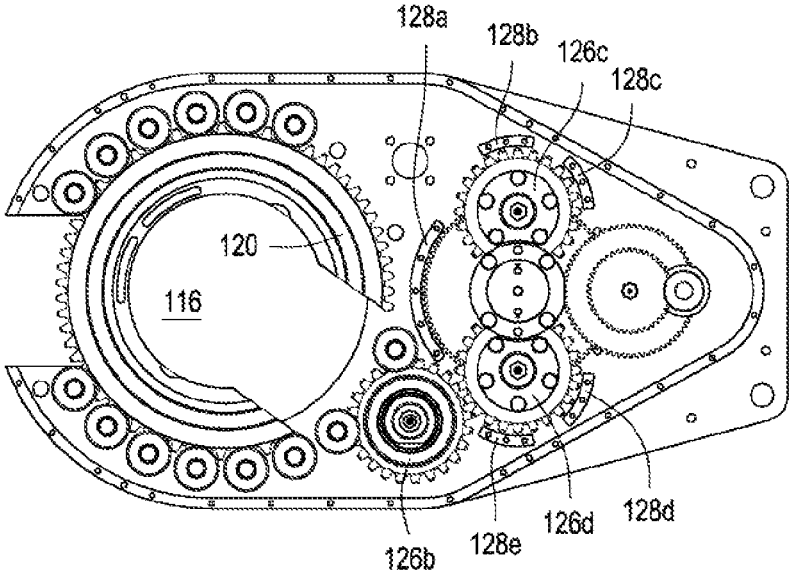
FIG. 13A shows a top plan view of FIG. 1D with a rotary gear assembly removed.
Figure 13B:
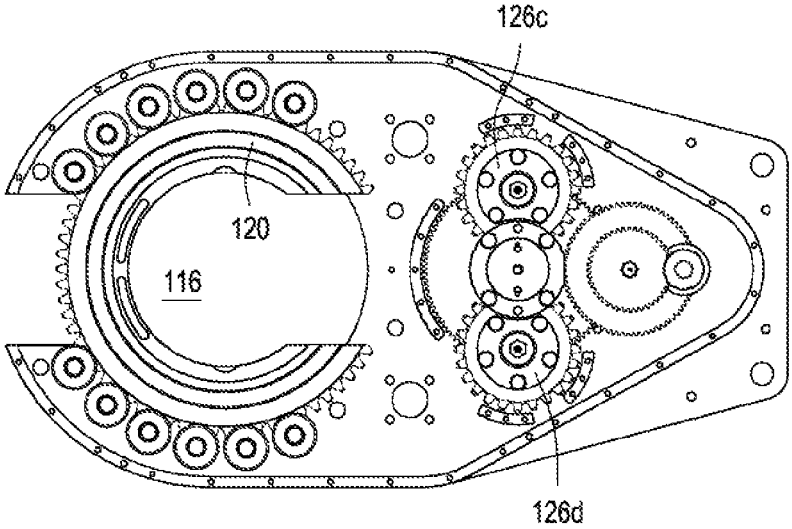
FIG. 13B shows a top plan view of FIG. 1D with two rotary gear assemblies and a strut removed.
Figure 13C:
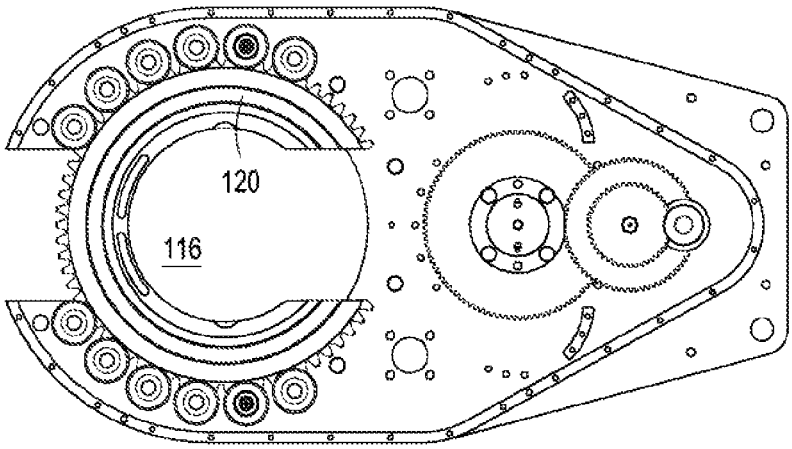
FIG. 13C shows a top plan view of FIG. 1D with two rotary gear assemblies, two pinion assemblies, and three struts removed.

Prior to removing or installing an internal component (e.g., gear assembly or strut) an operator must first rotate the cage plate assembly 120 so that the throat 118 may face the desired internal component, as shown in FIG. 13A.

Depending on the configuration of the gear train 124, a clear path without obstruction to a desired component may exist such that no other component needs to be removed, as shown in FIG. 13A. However, in alternative versions, removal of a desired component may require prior removal of other obstructing components that may be positioned between the desired component and the throat 118 of the cage plate assembly. For example, as shown in FIG. 13, a gear assembly 216*b* and strut 128*a* must be removed prior to removal of other gear assemblies 216*c*, 216*d* from behind.

Referring to the view C of the FIGS. 3-10, for gear assemblies 126 that include one or more threaded portions 218 removably coupled to a threaded assembly 226, an operator must first uncouple from each threaded portion 218 its corresponding threaded assembly 226. The operator may next remove any shaft retainer 210 coupled to the outer surface 112, 114 of the tong plates 106, 108. Afterward, where a tong plate aperture 220, 222 is sized to receive a non-threaded portion 216 of a gear shaft 214, the operator may slide the gear shaft 214 out through the tong plate aperture 220, 222, thereby freeing the gear 202 to be slid or moved laterally within the power tong 102 between the tong plates 106, 108, as shown in views C of the FIGS. 3-12. Finally, the operator may retrieve the gear from power tong 102 through the throat 118 of the cage plate assembly 120.

In alternative versions, as shown in the views C of FIG. 11 and FIG. 12, a gear 202 may be coupled to a gear shaft 214, having a flange 228 (shown in views A of FIG. 11 and FIG. 12) which may be removably coupled to a threaded assembly 226. Accordingly, the operator must first uncouple the threaded assembly 226 from the flange 228, thereby freeing the gear shaft 214 from physical contact with the tong plate 106, 108. Next, the still coupled gear 202 and gear shaft 214 may be slid or moved laterally within the power tong 102 between the tong plates 106, 108. Finally, the operator may retrieve the gear from power tong 102 through the throat 118 of the cage plate assembly 120.

To install a new component (e.g., gear assembly 202, strut 128), the operator may follow the steps described previously in reverse order.

What is claimed as the invention is:

1. A power tong for rotating tubulars in wellbore operations, comprising:

a gear shaft having a non-threaded portion;

a gear rotatably connected to the non-threaded portion of the gear shaft;

a tong plate having an inner surface, an outer surface, and a gear shaft aperture, wherein an end of the non-threaded portion is disposed in the gear shaft aperture; and a shaft retainer that is removably coupled to the tong plate and abutted against the end of the non-threaded portion.

2. The power tong of claim 1, wherein the gear shaft aperture is sized to receive the non-threaded portion of the gear shaft.

3. The power tong of claim 1, wherein the shaft retainer is abutted against the end of the non-threaded portion.

4. The power tong of claim 1, wherein the gear shaft is capable of ingress into or egress from the power tong through the gear shaft aperture.

5. The power tong of claim 1, wherein the gear is capable of being moved laterally within the power tong after egress of the gear shaft through the gear shaft aperture.

6. The power tong of claim 1, wherein the shaft retainer is removably coupled to the outer surface of the tong plate.

7. The power tong of claim 1, wherein the shaft retainer is coupled to the outer surface of the tong plate via a structure selected from the group of bolts, screws, clamps, welding, and adhesive.

8. The power tong of claim 1, wherein the shaft retainer comprises a flat plate with an inner surface and an outer surface, and the inner surface of the shaft retainer is disposed against the outer surface of the tong plate.

9. The power tong of claim 1, wherein the gear comprises a gear wheel having an aperture;

a bearing disposed concentrically in the aperture of the gear wheel; and one or more snap rings disposed in the aperture of the gear wheel.

10. A power tong for rotating tubulars in wellbore operations, comprising:

a gear shaft having a threaded portion and a non-threaded portion;

a gear rotatably connected to the non-threaded portion of the gear shaft;

a tong plate having an inner surface, an outer surface, and a gear shaft aperture, wherein an end of the non-threaded portion is disposed in the gear shaft aperture;

a shaft retainer having an aperture, wherein the shaft retainer is coupled to the outer surface of the tong plate and abutted against the end of the non-threaded portion; and a threaded assembly coupled to the threaded portion of the gear shaft and disposed against the outer surface of the shaft retainer.

11. The power tong of claim 10, wherein the threaded portion of the gear shaft extends through the aperture of the shaft retainer.

12. The power tong of claim 10, wherein the shaft retainer is abutted against the end of the non-threaded portion.

13. The power tong of claim 10, wherein the gear shaft aperture is sized to receive the non-threaded portion of the gear shaft.

14. The power tong of claim 10, wherein the gear shaft is capable of ingress into or egress from the power tong through the gear shaft aperture.

15. The power tong of claim 10, wherein the gear is capable of being moved laterally within the power tong after egress of the gear shaft through the gear shaft aperture.

16. The power tong of claim 10, wherein the shaft retainer is removably coupled to the outer surface of the tong plate.

17. The power tong of claim 10, wherein the shaft retainer is coupled to the outer surface of the tong plate via a structure selected from the group of bolts, screws, clamps, welding, and adhesive.

18. The power tong of claim 10, wherein the shaft retainer comprises a flat plate with an inner surface and an outer surface, and the inner surface of the shaft retainer is disposed against the outer surface of the tong plate.

19. The power tong of claim 10, wherein the threaded assembly comprises a nut having a threaded inner surface.

20. The power tong of claim 10, wherein the threaded assembly comprises a washer that is disposed against and in physical contact with the outer surface of the shaft retainer and a nut having a threaded inner surface that is disposed against and in physical contact with the washer.

* * * * *